US010837143B2

(12) United States Patent
Rajagopalan et al.

(10) Patent No.: US 10,837,143 B2
(45) **Date of Patent: *Nov. 17, 2020**

(54) THERMOREGULATORY COATINGS FOR PAPER

(71) Applicant: BIOASTRA TECHNOLOGIES, INC., Montréal (CA)

(72) Inventors: Sumitra Rajagopalan, Montreal (CA); Wilms Baille, Laval (CA); Piotr Kujawa, Montreal (CA); Abhilash Kulkarni, Boucherville (CA)

(73) Assignee: BIOASTRA TECHNOLOGIES, INC., Montreal (CA)

( * ) Notice: Subject to any disclaimer, the term of this patent is extended or adjusted under 35 U.S.C. 154(b) by 532 days.

This patent is subject to a terminal disclaimer.

(21) Appl. No.: 15/311,101

(22) PCT Filed: May 14, 2015

(86) PCT No.: PCT/CA2015/050442

§ 371 (c)(1),
(2) Date: Nov. 14, 2016

(87) PCT Pub. No.: WO2015/176178

PCT Pub. Date: Nov. 26, 2015

(65) Prior Publication Data

US 2017/0175339 A1 Jun. 22, 2017

Related U.S. Application Data

(60) Provisional application No. 61/993,127, filed on May 14, 2014.

(51) Int. Cl.
*D21H 27/10* (2006.01)
*D21H 19/56* (2006.01)
(Continued)

(52) U.S. Cl.
CPC ..... *D21H 27/10* (2013.01); *D21H 19/40* (2013.01); *D21H 19/52* (2013.01); *D21H 19/54* (2013.01);
(Continued)

(58) Field of Classification Search
CPC ..... D21H 27/10; D21H 19/40; D21H 19/52; D21H 19/54; D21H 19/56; D21H 19/58; D21H 19/66; D21H 19/82
See application file for complete search history.

(56) References Cited

U.S. PATENT DOCUMENTS 5,885,720 A * 3/1999 Fujiwara ..... D21H 19/12 428/511
9,963,627 B2 * 5/2018 Rajagopalan ..... C09K 5/14
(Continued)

FOREIGN PATENT DOCUMENTS

| | | | |
|---|---|---|---|
| CA | 2226773 | C | 7/1998 |
| CA | 2748801 | A1 | 7/2010 |
| WO | 2014071528 | A1 | 5/2014 |

OTHER PUBLICATIONS

James H. Johnston, "Nano-Structured Calcium Silicate Phase Change Materials for Packaging Temperature Sensitive Products," in Nanocomposites and Polymers with Analytical Methods 361-374 (2011).*

(Continued)

*Primary Examiner* — Nicholas E Hill
(74) *Attorney, Agent, or Firm* — BCF LLP

(57) ABSTRACT

There are provided thermoregulatory coatings for paper comprising a nano structured phase change material (PCM) and a protective layer, the PCM including a first agent that undergoes an endothermic phase transition at a desired temperature and a second agent that assists in maintaining a nano structure, and the protective layer providing a basecoat, a top-coat, or both. There are also provided coated papers
(Continued)

and articles comprising such coatings, and methods for preparation thereof. Coated papers and articles provided herein have a wide range of application, for example in packaging or transport of temperature-sensitive materials.

22 Claims, 21 Drawing Sheets

(51) Int. Cl.

| | |
|---|---|
| ***D21H 19/66*** | (2006.01) |
| ***D21H 19/82*** | (2006.01) |
| ***D21H 19/58*** | (2006.01) |
| ***D21H 19/40*** | (2006.01) |
| ***D21H 19/54*** | (2006.01) |
| ***D21H 19/52*** | (2006.01) |

(52) U.S. Cl.
CPC ..... *D21H 19/56* (2013.01); *D21H 19/58* (2013.01); *D21H 19/66* (2013.01); *D21H 19/82* (2013.01)

(56) References Cited

U.S. PATENT DOCUMENTS

| | | | | |
|---|---|---|---|---|
| 2005/0041406 | A1 | 2/2005 | Matayabas, Jr. et al. | |
| 2007/0158611 | A1 | 7/2007 | Oldenburg | |
| 2008/0305027 | A1 | 12/2008 | Johnston et al. | |
| 2012/0225290 | A1* | 9/2012 | Hartmann ..... | C08F 20/32 428/364 |

OTHER PUBLICATIONS

International Search Report, International Application No. PCT/CA2015/050442, dated Aug. 19, 2015.
Written Opinion, International Application No. PCT/CA2015/050442, dated Aug. 19, 2015.
Johnston, J. H. et al. "Nano-Structured Calcium Silicate Phase Change Material: A New Product for Thermal Buffering in Packaging." Appita Journal, 61 (5), pp. 366-369, Sep. 2008 (Sep. 2008).
Li, W.D. et al. "Preparation and Characerization of Poly(ethylene terephthalate) Fabrics Treated by Blends of Cellulose Nanocrystals and Polyethylene Glycol." Journal of Applied Polymer Science,105(2), pp. 373-378, Jul. 15, 2007 (Jul. 15, 2007).
Hawlader, M.N.A. et al. "Microencapsulated PCM Thermal-Energy Storage System" Applied Eneergy, 74(1-2), pp. 195-202, Jan. 2003 (Jan. 2003).

* cited by examiner

| Formulation | Basecoat? | Back | Front |
|---|---|---|---|
| Original | Yes |  |  |
| Original | No |  |  |
| 4 | Yes |  |  |
| 4 | No |  |  |
| 12x | Yes |  |  |

| Formulation | Basecoat? | Back | Front |
|---|---|---|---|
| 12x | No |  |  |
| 16 | Yes |  |  |
| 16 | No |  |  |

A

B

A

B

C

D

A

| | Uncoated @ 30 secs | Coated @ 30 secs |
|---|---|---|
| 100 $^0$C |   |   |
| 150 $^0$C |   |   |

B

C

A

B

C

D

E

F

THERMOREGULATORY COATINGS FOR PAPER

CROSS-REFERENCE TO RELATED APPLICATIONS

This application claims the benefit of U.S. Provisional Patent Application No. 61/993,127 filed May 14, 2014, the entire contents of which are hereby incorporated by reference.

FIELD OF THE INVENTION

This invention relates to thermoregulatory coatings for paper and paper-based materials having thermal buffering properties for a wide range of applications. In particular, there are provided paper-based packaging materials coated with nanostructured phase-change materials (PCMs) that undergo an endothermic phase change transition, methods for preparation and applications thereof.

BACKGROUND

Many polymers undergo an endothermic phase change within a specific temperature range. There are several types of such phase-change polymers. Low-melting polymers such as Poly(ethylene glycol), pluronic and Poly(caprolactone) undergo a melting transition at temperatures ranging from 15° C. to 60° C. Another class of polymers are the temperature-responsive polymers, that undergo a coil-to-globule transition at critical temperatures. For example, such polymers may undergo a phase change at a critical temperature known as the Lower Critical Solution Temperature (LOST) or at a critical temperature known as the Upper Critical Solution Temperature (UCST). At the LOST polymers transition from a single phase into a two-phase system. Such polymers include Poly(N-isopropylacrylamide), Hydroxypropyl methylcellulose (HPMC), and Poly (diethylacrylamide), among others. The LOST can also be observed for thermoresponsive polymers in the solid state (Liu and Urban, Macromolecules, 42(6) pp. 2161-2167, 2009). A critical temperature for phase change can be adjusted to a desired range through copolymerization with more hydrophilic polymers or hydrophobic polymers to increase or decrease the temperature, respectively. Some polymers are known to undergo a coil-to-globule transition, which is an endothermic phase transition and leads to significant heat absorption, generally in the range of about 50-200 J/g.

Many phase-change materials (PCMs) are known and have been used for thermoregulation, e.g., for keeping various articles within a desired temperature range. However, while maximum heat absorption can be achieved through an endothermic melting transition, known PCMs are unsuitable for application on substrates such as paper and paper-based packaging materials without an encapsulating agent, due to a need to contain the liquid produced by solid-liquid transitions. However, microencapsulation greatly reduces the enthalpy of heat absorption, highly limiting the buffering capacity of these materials. Further, microcapsules do not naturally adhere to many substrates, requiring fixative agents to promote adherence to substrates.

Use of nanocrystalline particles to improve mechanical properties of PCMs and to obtain solid-solid phase transitions has been reported. Yuan et al. (Yuan et al., Chinese Chemical Letters, Vol. 17, No. 8, pp 1129-1132, 2006) grafted PEG chains onto nanocrystalline particles to avoid the need to encapsulate the phase change material, and solid-solid phase transitions were obtained. However, the heat absorption capacity of the resulting nanocrystalline particles was far lower than the capacity of the starting material, resulting in poor performance as compared to encapsulated products already available. Such nanocrystalline particles therefore fail to overcome the limitations of existing PCMs.

Coatings for paper and packaging substrates present certain challenges. For example, such coatings may need to be able to withstand high temperatures or pressures used during paper application, processing, drying, lamination, or corrugation.

SUMMARY

There are provided herein thermoregulatory coatings for paper and coated papers which overcome at least some of the disadvantages of the prior art. Coated papers provided herein comprise at least on one side a thermoregulatory coating having thermal buffering properties. Such thermoregulatory coatings and coated papers may be used for a range of applications, including packaging materials.

In an aspect, there are provided herein thermoregulatory coatings for paper comprising a nanostructured phase-change material (PCM) in combination with a protective layer, e.g., a basecoat and/or a topcoat. Thermoregulatory coatings provided herein may have one or more of the following advantages: they do not give paper a greasy feel after coating; they can withstand high temperatures and/or pressures used during paper application, processing, drying, lamination or corrugation; they dry effectively; they do not saturate the paper substrate, so that multiple or subsequent coats are possible; they are capable of application directly onto the paper substrate; they are capable of application onto paper in the absence of a fixative or crosslinking agent; they are safe and/or non-toxic; and/or they provide efficient thermal buffering properties to the paper. In some embodiments, coatings provided herein undergo solid-solid phase transitions. In some embodiments, thermoregulatory coatings can be directly applied onto paper, e.g., through wet-end processing or dry processing.

In other aspects, there are provided herein coated papers and articles comprising thermoregulatory coatings, and methods for applying such coatings to a substrate, e.g., a paper. Methods for making coated papers and articles having thermal buffering properties are also provided.

In an embodiment, there is provided a thermoregulatory coating for paper comprising a nanostructured phase-change material (PCM) and at least one protective layer, wherein the nanostructured PCM comprises at least one first agent (e.g., at least one phase-change polymer, or at least one fatty acid) that undergoes a solid-solid phase transition or an endothermic phase transition at a desired transition temperature, and wherein at least about 50 J/g is absorbed or released during the solid-solid phase transition. The at least one protective layer may be a topcoat, a basecoat, or may include both a topcoat and a basecoat. In some embodiments, the nanostructured PCM further comprises at least two phases, at least one phase having dimensions in the nanoscale. A nanostructured PCM may comprise an agent that assists in maintaining the nanoscale dimensions.

In an embodiment, a thermoregulatory coating for paper comprises a nanostructured PCM which is a PCM nanoemulsion. In such embodiments, the at least one protective layer is typically a film-forming polymer, such as, without limitation, chitosan, poly(vinyl alcohol) (PVA), poly(vinylpyrollidone) (PVP), poly(ethylene glycol) (PEG), a polysaccharide, a polyamine, or an amphiphilic polymer that undergoes a hydrophobic-hydrophilic transition at a temperature of at least about 60° C. or of about 60 to about 80° C. (e.g., hydroxypropyl methylcellulose or a copolymer of poly(N-isopropylacrylamide) and acrylic acid). In some embodiments, a film-forming polymer is hydrophobically-modified. For example, a film-forming polymer may be a polymer having side-chain pendant hydroxyl groups, which may be hydrophobically modified, e.g., by acetylation, e.g., through a chloride derivative of a fatty acid ester. In some embodiments, a film-forming polymer having side chain pendant groups is acetylated chitosan or acetylated PVA. In an embodiment, a protective layer is PVA or PVP.

In an embodiment, the heat absorption of a film-forming polymer having side chain pendant groups is increased by about 10%, about 20%, about 25%, about 30%, or about 40% compared to the heat absorption of the unmodified film-forming polymer, i.e., the film-forming polymer without side chain pendant groups. In one embodiment, the film-forming polymer having side chain pendant groups is acetylated PVA, e.g., PVA acetylated using lauroyl chloride. In an embodiment, the heat absorption of the film-forming polymer having side chain pendant groups, e.g., acetylated PVA, is increased by about 25% compared to the heat absorption of unmodified film-forming polymer, e.g., non-acetylated PVA.

In some embodiments, a protective layer in a thermoregulatory coating comprises an amphiphilic polymer for use as a topcoat, wherein the amphiphilic polymer undergoes a hydrophobic-hydrophilic transition at high heat and/or pressure, e.g., during drying of a thermoregulatory coating on a paper, or during lamination or corrugation of a paper after coating.

In an embodiment, a thermoregulatory coating for paper comprises a PCM nanoemulsion, wherein the PCM nanoemulsion comprises a continuous phase and a dispersed phase, the dispersed phase comprising at least one first agent that undergoes an endothermic phase transition or a solid-solid phase transition at a desired transition temperature, wherein at least about 50 J/g is absorbed or released during the solid-solid phase transition, and the continuous phase comprising at least one second agent that does not substantially adversely affect heat absorption of the at least one first agent; and at least one protective layer, the at least one protective layer comprising a film-forming polymer having side-chain pendant hydroxyl groups.

In an embodiment, a first agent in a thermoregulatory coating is a fatty acid, a fatty acid ester, a low molecular weight phase change polymer, a phase-change polymer, a low-melting small molecule, a paraffin, an oligomer of PEG, or a combination or mixture thereof.

In an embodiment, a second agent in a thermoregulatory coating maintains a nanostructure and/or enhances film-forming properties of the PCM nanoemulsion. In some embodiments, a second agent is an emulsifier, a surfactant, a film-forming polymer, a binder, or a combination or mixture thereof. For example, a second agent may be Tween, Sodium Dodecyl Sulphate (SDS), Pectin, Egg Lecithin, Span, sodium caseinate, poly(vinyl alcohol) (PVA), poly (vinyl pyrrolidone) (PVP), hydroxypropyl cellulose (HPC), chitosan, or a combination or mixture thereof.

In an embodiment, a first agent in a thermoregulatory coating is methyl palmitate, methyl stearate, or a mixture thereof. In one embodiment, a first agent in a thermoregulatory coating is methyl stearate. In an embodiment, a first agent in a thermoregulatory coating is PEG. For example, a first agent may be PEG400, PEG500, PEG600, PEG650, PEG800, PEG900, PEG950, PEG1000, PEG1050, PEG1500, PEG2000, PEG2500, PEG3000, or PEG3500, or the PEG is a mixture of PEG of different molecular weights selected such that the PEG mixture undergoes a solid-solid phase transition at a desired transition temperature.

In an embodiment, a thermoregulatory coating comprises a PCM nanoemulsion which is a mixture of fatty acid esters encapsulated in nanodroplets stabilized by sodium caseinate. In an embodiment, the PCM nanoemulsion is a mixture of fatty acid esters stabilized with sodium caseinate in a continuous phase of poly(vinyl alcohol) or other film-forming polymer.

In an embodiment, a thermoregulatory coating comprises a PCM nanoemulsion which is prepared through shear mixing at a very high speed, such as a speed of about 9000 rpm.

In an embodiment, a thermoregulatory coating comprises a PCM nanoemulsion which comprises at least one first agent dispersed in a solvent. A solvent may be, for example, water or a dilute solution of a hydrophilic polymer such as poly(vinyl alcohol).

In an embodiment, a thermoregulatory coating comprises at least one first agent which is a mix of methyl palmitate and methyl stearate, and at least one second agent which is sodium caseinate. In some embodiments, the ratio of sodium caseinate: fatty acid ester (w/w) is from about 1:05 to about 1:45. In some embodiments, the at least one first agent comprises about 80% methyl palmitate and about 20% methyl stearate. In some embodiments, the at least one first agent is dispersed in a water-based starch solution or in a water-based poly(vinyl alcohol) solution. In some embodiments, the continuous phase is no more than 5% of the nanoemulsion.

In some embodiments, a thermoregulatory coating comprises at least one first agent which is methyl stearate and at least one second agent which is a binder. A non-limiting example of a binder is a hycar acrylic emulsion, such as Hycar 26552. In an embodiment, a thermoregulatory coating comprises a PCM nanoemulsion that comprises methyl stearate and a binder, e.g., a hycar acrylic emulsion, e.g., Hycar™ 26552. In an embodiment, the PCM nanoemulsion in the thermoregulatory coating comprises methyl stearate and a binder in a ratio of about 2:1 to about 3:1, or about 2.3:1, methyl stearate:binder.

In an embodiment, a thermoregulatory coating comprises a PCM nanoemulsion wherein the continuous phase has no heat-absorbing properties of its own. In some embodiments, the at least one second agent does not substantially adversely affect heat absorption of the at least one first agent, and/or increases heat absorption of the at least one first agent. In some embodiments, the ratio of the first agent to the second agent is about 5:1 or about 9:1.

In an embodiment, a thermoregulatory coating for paper comprises a nanocomposite PCM. In such embodiments, the at least one protective layer may be a high molecular weight hydrophilic polymer. A high molecular weight hydrophilic polymer may have a molecular weight of 10,000 daltons or higher. For example, a high molecular weight hydrophilic polymer may be polyethylene oxide (PEO), poly(vinyl alcohol) (PVA), chitosan, poly(vinyl pyrollidone) (PVP), or a mixture thereof.

In an embodiment, a thermoregulatory coating comprises a nanocomposite PCM, wherein the nanocomposite PCM comprises at least one phase-change polymer and a nanocrystalline filler having a high aspect ratio, wherein the at least one phase-change polymer and the nanocrystalline filler interact together non-covalently, and the nanocrystalline filler does not substantially adversely affect heat absorption of the phase-change polymer or increases heat absorption by the phase-change polymer. In some embodiments, a phase-change polymer is poly(ethylene glycol) (PEG), such as PEG400,PEG500, PEG600, PEG650, PEG800, PEG900, PEG950, PEG1000, PEG1050, PEG1500, PEG2000, PEG2500, PEG3000, PEG3500, or a mixture of PEG of different molecular weights selected such that the PEG mixture undergoes a solid-solid phase transition at a desired transition temperature. In an embodiment, a phase-change polymer has the following structure:

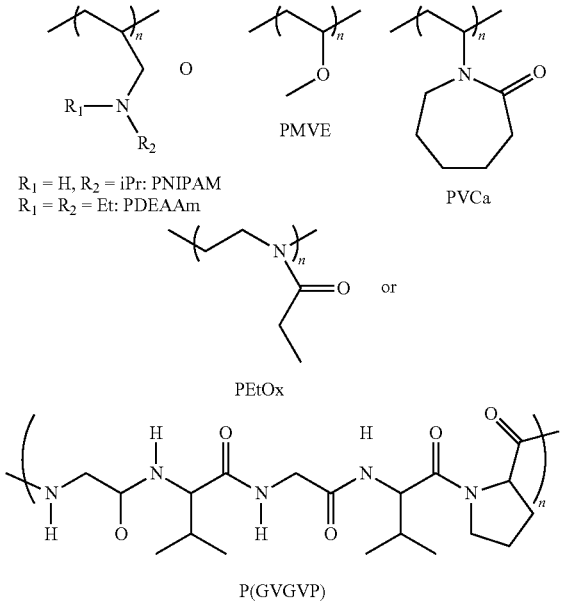

wherein n is selected such that the phase-change polymer undergoes a solid-solid phase transition at a desired transition temperature. In an embodiment, 1<n<1000.

In some embodiments, a nanocrystalline filler in a nanocomposite PCM in a thermoregulatory coating is nanocrystalline cellulose (NCC) or a clay. A nanocrystalline filler may be, for example, a nanocrystalline starch, a nanoclay, a carbon nanotube, an organic nanoclay, or an organoclay such as montmorillonite, bentonite, kaolinite, hectorite, or halloysite. In an embodiment, a nanocrystalline filler reflects IR radiation. In an embodiment, a nanocrystalline filler is Poly(γ-benyzl glutamate).

In an embodiment, a nanocomposite PCM in a thermoregulatory coating comprises no more than about about 5% nanocrystalline filler by weight. In some embodiments, a nanocomposite PCM in a thermoregulatory coating comprises no more than about 3 wt %, about 5 wt %, about 8 wt %, about 5-8 wt %, about 10 wt %, or about 25 wt % of nanocrystalline filler. In an embodiment, a nanocomposite PCM in a thermoregulatory coating comprises about 5 wt % to about 25 wt % nanocrystalline filler. In an embodiment, a nanocomposite PCM in a thermoregulatory coating comprises at least about 90% or at least about 95% of phase-change polymer by weight.

In an embodiment, a thermoregulatory coating comprises a nanocomposite PCM, wherein a phase-change polymer is dispersed in a nanocrystalline filler to form a solid solution.

In some embodiments provided herein, a thermoregulatory coating comprises a first layer and a second layer, the second layer being applied on top of the first layer, wherein the first layer comprises the nanostructured PCM, and the second layer comprises the protective layer. In alternative embodiments, a coating comprises a first layer and a second layer, the second layer being applied on top of the first layer, wherein the first layer comprises the protective layer, and the second layer comprises the nanostructured PCM. Thermoregulatory coatings may further comprise a third layer applied on top of the second layer, the third layer comprising a second nanostructured PCM or a second protective layer, as appropriate. Such coatings may further comprise a fourth layer applied on top of the third layer, the fourth layer comprising another nanostructured PCM or protective layer, as appropriate; and so on. It should be appreciated that multiple layers may be applied on a substrate, e.g., a paper. Typically, alternating layers of nanostructured PCM and protective layer will be applied on top of each other, forming a "sandwich" of nanostructured PCM/protective layers.

In an embodiment, a thermoregulatory coating comprises a first protective layer (i.e., a basecoat); a first nanostructured PCM; and a second protective layer (i.e., a topcoat). Such coatings may comprise further alternating layers of nanostructured PCM and protective layer, i.e., may comprise a second nanostructured PCM, followed by a third protective layer, etc. Multiple layers may be applied in this way; the number of layers to be applied will be determined based on the amount of thermal buffering desired, the ability of a substrate to receive more layers, and other such factors. It should be understood that, when multiple layers are used, a second nanostructured PCM may be the same or different as a first nanostructured PCM. Further, the transition temperature of a second nanostructured PCM may be the same or different as that of a first nanostructured PCM. Similarly, a first and a second protective layer may be the same or different.

In an embodiment, a protective layer in a thermoregulatory coating prevents a nanostructured PCM from migrating towards a paper, and/or saturating the paper during coating, during drying through heat, during lamination and/or during corrugation. In an embodiment, a protective layer prevents a nanostructured PCM from giving a greasy look or feel to a paper coated therewith.

In an embodiment, a transition temperature for a thermoregulatory coating and/or a phase-change polymer is from about 1 to about 6° C., from about 19 to about 24° C., or from about 60 to about 80° C. In some embodiments, a transition temperature is from 1-6° C., 30-39° C., 35-37° C., 19-24° C., 20-24° C., 20-25° C., 25-30° C., 35-40° C., 33-40° C., or 60-80° C.

In an embodiment, a thermoregulatory coating is applied to a substrate, e.g., a paper. A paper may be, for example, kraft paper, beehive paper, aluminium laminated paper, metallized paper, grease-proof paper, vacuum panel, board, cardboard, paperboard, foam insert, or containerboard.

In an embodiment, a thermoregulatory coating and/or a phase-change polymer absorbs or releases about 50-200 J/g of heat during a solid-solid phase transition or an endothermic phase transition. In some embodiments, at least about 100 J/g, or at least about 150 J/g of heat is absorbed or released during a solid-solid or endothermic phase transition. In an embodiment, a thermoregulatory coating or a phase-change polymer absorbs or releases about 50-200 J/g, at least about 50 J/g, at least about 100 J/g, at least about 150 J/g, or at least about 200 J/g of heat during a solid-solid phase transition.

In an embodiment, a thermoregulatory coating comprises a nanostructured PCM having a solids content of 85% or less. In some embodiments, a thermoregulatory coating or a nanostructured PCM has a solids content of at least 50%, at least 55%, or at least 60%. In some embodiments, a thermoregulatory coating or a nanostructured PCM has a solids content of from about 55% to about 85%, from about 50% to about 85%, from about 60% to about 85%, or from about 55% to about 65%. In some embodiments, a thermoregulatory coating or a nanostructured PCM has a viscosity of at least about 200 cP, at least about 400 cP, at least about 800 cP, or at least about 1000 cP at 40° C. In some embodiments, a thermoregulatory coating or a nanostructured PCM has a viscosity of 150 cP or less at room temperature.

In an embodiment, a thermoregulatory coating is applied to a substrate, e.g., a paper, wherein the thermoregulatory coating is loaded onto the paper at a loading ratio of from about 10 to about 100 grams per square meter, from about 60 to about 100 grams per square meter, or from about 20 to about 30 grams per square meter.

In an embodiment, a thermoregulatory coating is stable or can withstand high temperatures and/or pressures, such as temperatures and/or pressures typically used during paper application, processing, drying, lamination, or corrugation of papers. For example, a thermoregulatory coating may be stable at temperatures of 60° C. or higher, temperatures of 80° C. or higher, and/or pressures of 400 psi or higher.

In an embodiment, a thermoregulatory coating or a paper coated therewith does not look or feel greasy.

In an embodiment, a thermoregulatory coating is non-flammable, non-toxic, and/or food-safe.

In an aspect, a thermoregulatory coating is applied or loaded onto a substrate, e.g., a paper. In an aspect therefore, there are provided coated papers comprising a thermoregulatory coating described herein. A coated paper may be, for example, kraft paper, beehive paper, aluminium laminated paper, metallized paper, grease-proof paper, vacuum panel, board, cardboard, paperboard, foam insert, or containerboard. In some embodiments, a coated paper is recyclable and/or repulpable. In some embodiments, a coated paper may be used to form a box, a package, a container, a liner, a vacuum insulation panel, an envelope, or a packaging material.

In an embodiment, a coated paper comprises from about 10 to about 100 grams per square meter of a thermoregulatory coating.

In another aspect, there are provided articles comprising a thermoregulatory coating described herein, or constructed from a coated paper described herein. Such an article may be, for example, a box, a package, a container, an envelope, a vacuum insulation panel, a liner, or a packaging material. An article may be used for packaging or transporting a temperature-sensitive product, such as an agricultural product, a biological product, a medical product, a biomedical product, or an industrial product. A temperature-sensitive product may be, for example, a food (e.g., a milk product, a meat product, a fruit, a vegetable, a pizza, a candy, chocolate), a medicine, a vaccine, or a blood product. In an embodiment, an article is a pre-impregnated composite resin, such as for use in aerospace applications.

In an embodiment, an article comprises about 600 grams per square meter of a nanostructured PCM. In an embodiment, an article further comprises, on the inside, a coated paper. For example, a coated paper may be placed inside an article to increase the article's thermal buffering capacity. In some embodiments, a coated paper is used to form a compartment inside an article. In some embodiments, an article's thermal buffering capacity may be further maximized or increased by packing with minimum void volume and/or air pockets.

In some embodiments, an article is a material for transportation packaging (such as a disposable, paper or cardboard box) to provide thermal protection of temperature-sensitive products such as food, blood, plasma, vaccines, and other medical products. In some embodiments, an article is a material for food packaging, e.g., a material for packaging chocolate.

In yet another aspect, there are provided kits comprising thermoregulatory coatings described herein and instructions for use thereof to apply thermoregulatory coatings to a substrate or article. For example, a kit may include a nanostructured PCM, a polymer for use as a basecoat and/or a topcoat (e.g., a hydrophobically modified polymer, an amphiphilic polymer that undergoes a hydrophobic-hydrophilic transition at a temperature of at least about 60° C. or of about 60 to about 80° C., a HPMC solution, a copolymer of poly(N-isopropylacrylamide) and acrylic acid, a copolymer of poly(N-isopropylacrylamide) and tert butyl acrylate, etc.), and instructions for application onto a paper. A HPMC solution may be, for example, a 5% solution of hydroxypropyl methylcellulose in water having a transition temperature of from about 70° C. to about 80° C. In some embodiments, a kit comprises PVA or PVP for use as a basecoat. In some embodiments, a kit comprises a hydrophobically modified polymer such as acetylated chitosan or acetylated PVA for use as a protective layer. In some embodiments, a kit comprises an amphiphilic polymer for use as a topcoat, wherein the amphiphilic polymer undergoes a hydrophobic-hydrophilic transition drying of the thermoregulatory coating on the paper, or during lamination or corrugation of the paper after coating.

In some embodiments, a kit comprises three bottles and instructions for use to apply a thermoregulatory coating on a substrate or article, e.g., on a paper, the three bottles containing: 1) a nanostructured PCM, e.g., PCM nanoemulsion formulation no. 4; 2) a basecoat comprising a 10% solution of an appropriate polymer, e.g., PVA; and 3) a topcoat, e.g., HPMC in a solution of 3:1 ethanol:water. In an embodiments, the instructions are as follows: carefully apply the basecoat (e.g., PVA solution) to the paper using a bar coater and thereafter place the paper in an oven at 70° C. to remove all solvent; to the dried basecoat, apply nanostructured PCM (e.g., Formulation 4) and dry further using hot air; finally, apply the topcoat (e.g., HPMC) to cover the nanostructured PCM and dry at room temperature.

In an aspect, there are provided methods for preparing a coated paper having thermoregulatory or thermal buffering properties. In an embodiment, a method comprises: (a) optionally pretreating the surface of a paper by washing and cleaning the surface to remove contaminants; (b) optionally applying a basecoat to the paper, the basecoat being a protective layer as described herein; (c) applying a solution comprising a nanostructured PCM as described herein to the paper, and mixing; (d) drying the solution of nanostructured PCM; and (e) optionally applying a topcoat to the paper, the topcoat being a protective layer as described herein; wherein at least one of steps (b) and (e) is performed, i.e., at least one of a basecoat and a topcoat is applied to the paper. In some embodiments, both steps (b) and (e) are performed, i.e., both a basecoat and a topcoat are applied to the paper. In some embodiments, steps (b) through (e) are repeated at least once. In some embodiments, in step (c) the solution comprising the nanostructured PCM is applied to pulp during wet-end processing, while the paper is being formed. For example, in step (c) the solution comprising the nanostructured PCM is applied as a wet-end additive. In some embodiments, in step (c) the solution comprising the nanostructured PCM is applied onto formed paper and/or step (c) comprises a dry processing step. In some embodiments, the solution comprising a nanostructured PCM is applied onto paper using bar coating, rod coating, flexography or rotogravure.

In an aspect, there are provided methods for preparing a box, a package, a container, an envelope, a vacuum insulation panel, a packaging material, or a liner having thermoregulatory properties, the method comprising: (1) preparing a coated paper as described herein; and (2) converting the coated paper into a box, package, container, envelope, vacuum insulation panel, packaging material or liner. A coated paper as described herein may thus be used to construct a box, a package, a container, an envelope, a vacuum insulation panel, a packaging material, or a liner having thermoregulatory properties. In some embodiments, step (2) comprises lamination and/or corrugation. In some embodiments, a solution comprising a nanostructured PCM is added to laminating glue, to maximize or increase thermal buffering capacity of the resulting article. Such laminating glue may comprise, for example, poly(vinyl acetate), chitosan, poly(vinyl pyrollidone), and/or starch.

In some embodiments, a coated paper or article as described herein may further comprise a thermoresponsive color-release system such that color is released at the transition temperature, or during or after the solid-solid or endothermic phase transition. For example, a thermoresponsive color-release system may comprise a second phase-change polymer and a dye, the second phase-change polymer having a second transition temperature the same as or higher (e.g., slightly higher) than the desired transition temperature of the nanostructured PCM, such that the second phase-change polymer undergoes a phase change and releases the dye at the same time as, or after, the at least one phase-change polymer in the nanostructured PCM undergoes the solid-solid phase transition.

In some embodiments, a coated paper or article described herein is suitable for reuse through cooling, the cooling reversing the solid-solid phase change of the at least one phase-change polymer in the nanostructured PCM, such that it can be used again to provide thermal buffering.

BRIEF DESCRIPTION OF THE DRAWINGS

For a better understanding of the invention and to show more clearly how it may be carried into effect, reference will now be made by way of example to the accompanying drawings, which illustrate aspects and features according to embodiments of the present invention, and in which.

Figure 1:
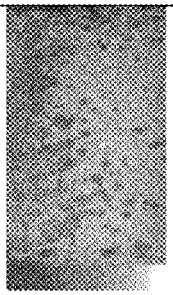
FIG. 1 shows photographs of the back and front side of paper coated with the indicated formulation, with or without a basecoat as indicated.
Figure 1:
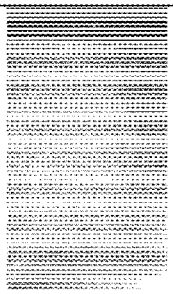
Figure 1:
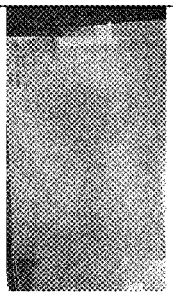
Figure 1:
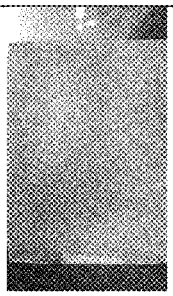
Figure 1:
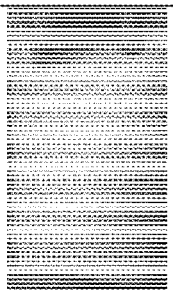
Figure 1:
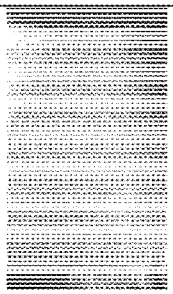
Figure 1:
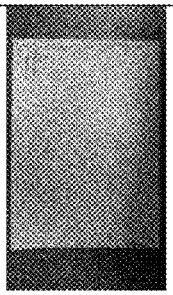
Figure 1:
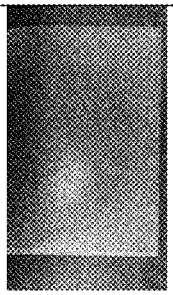
Figure 1:
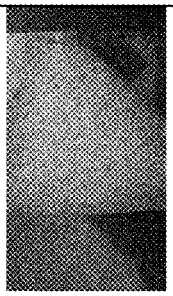
Figure 1:
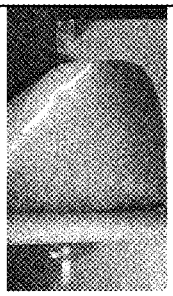
Figure 1:
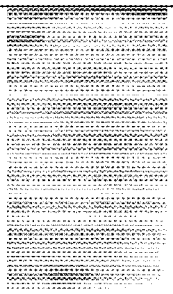
Figure 1:
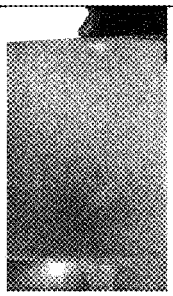
Figure 1:
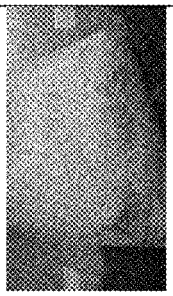
Figure 1:
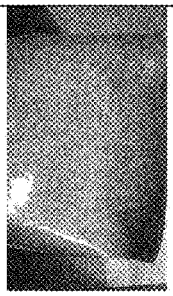
Figure 1:
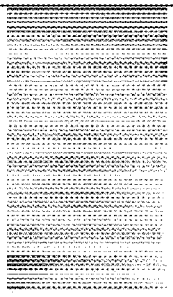
Figure 1:
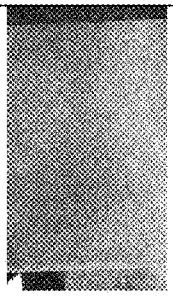

(E): TGA PVA octanoyl chloride with 27% of PCM. (F): PVA octanoyl chloride with 27% of PCM, transition temperature: 30.7° C.

DETAILED DESCRIPTION

We report herein the preparation and use of thermoregulatory coatings for paper comprising a nanostructured phase change material (PCM) and at least one protective layer, the nanostructured PCM comprising at least one phase-change polymer that undergoes a solid-solid phase transition or an endothermic phase transition at a desired transition temperature, wherein at least about 50 J/g is absorbed or released during the solid-solid phase transition. Thermoregulatory coatings provided herein are capable of wide application to provide thermal buffering for a variety of substrates and articles.

As used herein, a "nanostructured PCM" is a phase-change material comprising at least one first agent that undergoes an endothermic phase transition, e.g., that absorbs a significant amount of heat, in a desired temperature range or at a desired transition temperature, and at least one second agent, wherein the second agent assists in maintaining a nanostructure, and wherein the nanostructured PCM has at least two phases, at least one of the phases having at least one of its dimensions in the nanoscale. As used herein, "nanoscale" dimensions refers to dimensions that are greater than or equal to one nanometer and less than or equal to one micron. In some embodiments, the second agent that assists in maintaining a nanostructure does not substantially adversely affect heat absorption of the first agent. In an embodiment, the second agent that assists in maintaining a nanostructure increases heat absorption of the first agent.

Two types of nanostructured PCMs are described herein for use in thermoregulatory coatings: nanocomposite PCMs and PCM nanoemulsions.

Diverse nanostructured PCMs are described herein for use in thermoregulatory coatings, which share the properties of: 1) maintaining a solid or solid-like state through an endothermic phase transition, and 2) having at least two phases, at least one of the phases having at least one of its dimensions in the nanoscale. In some embodiments, nanostructured PCMs also share the property that the first agent's thermal properties are not substantially adversely altered, or in some embodiments, the first agent's thermal properties are enhanced, by the second agent. In some embodiments, nanostructured PCMs do not require high amounts of fillers such as encapsulating agents, reinforcing agents, or fixatives, therefore maximizing heat absorption using minimal quantities of material.

In an embodiment, a nanostructured PCM is a solid-state polymer-based nanostructured PCM that can be directly coated from solution or melted onto a substrate or article, e.g., paper, to form an adherent, functional film without the need for encapsulants or binders and/or fixatives. In some embodiments, the presence of high-aspect ratio nanosized fillers in the PCM ensures that the PCM maintains its solid state during a phase transition without reducing the enthalpy of the phase transition, thus making it suitable for applications such as packaging, where direct coating on a substrate may be preferred. In one embodiment, there is provided a formulation that is a PCM nanoemulsion in which a mixture of fatty acid esters are encapsulated in nanodroplets stabilized by sodium caseinate. The sodium caseinate acts as a surfactant or emulsifier. In a further embodiment, sufactant-stabilized droplets are dispersed in a film-forming polymer that forms a stable coating when dried. In another embodiment, there is provided a thermoregulatory coating comprising a nanocomposite PCM in which a high-aspect ratio nanosized filler such as a nanoclay or NCC is dispersed in a known phase-change polymer such as PEG. In yet another embodiment, a first agent comprises two materials with phase-change properties (e.g., PEG and a polyalcohol) mixed together in order to form a homogeneous first agent for use in a nanostructured PCM with a solid-solid transition. In this embodiment, a polyalcohol may also behave as a filler to reinforce the first agent or PEG matrix.

As used herein, when content is indicated as being present on a "weight basis" or at a "weight percent (wt %)" or "by weight." the content is measured as the percentage of the weight of component(s) indicated, relative to the total weight of all components present in a nanostructured PCM.

In another embodiment, a nanostructured PCM further comprises a component which shifts the transition temperature of a first agent, e.g., a phase-change polymer, such that the first agent undergoes a solid-solid phase transition at a desired transition temperature. The component may be, for example, a freezing point depressant such as sodium chloride, calcium chloride, potassium chloride, magnesium chloride, ethylene glycol, glycerol, sorbitol, lactitol, sucrose, lactose, palatinol, erythritol, corn syrup, xylitol, lactose, a fatty acid, or a combination thereof. In some embodiments, the heat absorption of the first agent, e.g., a phase-change polymer, in a nanostructured PCM is not substantially adversely affected by the component. In some embodiments, the heat absorption of the phase-change polymer is increased by the component, e.g., by at least about 5-10%.

Other methods of shifting the transition temperature of a phase-change polymer are known in the art and may be used, in order to obtain a desired transition temperature for a phase-change polymer or a nanostructured PCM. For example, melting point of a phase-change polymer may be modulated through fractionation of polymers to extract only those of a certain molecular weight. For example, monodisperse PEG 600 has a transition point of 25° C., whereas the transition point of monodisperse PEG 5000 is 63° C. Transition temperature of thermoresponsive polymers can also be modulated through copolymerization with hydrophilic or hydrophobic comonomers to increase or decrease LOST, respectively. For example, copolymerizing NIPAAM with butyl acrylate decreases LOST, whereas copolymerization with acrylamide increases LOST.

In an embodiment, a phase-change polymer is mixed with a component which modulates the transition temperature of the phase-change polymer, so that a desired transition temperature is obtained. The component may be, e.g., a low molecular weight compound such as a fatty acid, or a freezing point depressant. In one embodiment, the component modulates the transition temperature without substantially adversely affecting heat absorption or enthalpy of the phase-change polymer. In another embodiment, the component increases heat absorption or enthalpy of the phase-change polymer, e.g., by at least about 5-10%.

In another embodiment, a nanostructured PCM, e.g., a nanocomposite PCM or a PCM nanoemulsion, comprises more than one phase-change polymer, e.g., two phase-change polymers. Combining more than one phase-change polymer may be advantageous to provide a polymer having desired properties, such as desired thermoregulatory or mechanical properties, e.g., a desired tensile modulus. In an embodiment, two phase-change polymers are combined to form a "double gel" polymer having mechanical properties, e.g., tensile modulus, much higher than that of a single phase-change polymer. In another embodiment, a second phase-change polymer may enhance adhesion of a nanostructured PCM to a substrate, without affecting the core thermal properties of the first phase-change polymer or of the nanostructured PCM. Phase-change polymers are typically combined prior to reinforcement with a nanocrystalline filler to form a nanocomposite PCM.

As used herein, the term "heat absorption" or "heat capacity" refers to an amount of heat absorbed or released by a material as it undergoes a transition between two states. Thus, for example, a heat absorption or heat capacity can refer to an amount of heat that is absorbed or released as a material undergoes a transition between a liquid state and a crystalline solid state, a liquid state and a gaseous state, a crystalline solid state and a gaseous state, two crystalline solid states, or a crystalline state and an amorphous state. "Heat absorption" or "heat capacity" also refers to an amount of heat absorbed or released by a material as it undergoes a coil-to-globule transition.

As used herein, the term "transition temperature" refers to an approximate temperature at which a material undergoes a transition between two states, i.e., a phase transition. Thus, for example, a transition temperature can refer to a temperature at which a material undergoes a transition between a liquid state and a crystalline solid state, a liquid state and a gaseous state, a crystalline solid state and a gaseous state, two crystalline solid states or crystalline state and amorphous state. "Lower critical transition temperature" or LCST is used herein in some cases to refer to the transition temperature at which a phase-change polymer displays a coil-to-globule transition which is endothermic.

As used herein, the term "phase-change material" or "PCM" refers to a material that has the capability of absorbing or releasing heat to adjust heat transfer at or within a temperature stabilizing range. The term "nanocomposite PCM" is used herein to refer to nanostructured PCMs comprising a phase-change polymer (a first agent) reinforced with a nanocrystalline filler (a second agent, such as NCC or clay). The term "PCM nanoemulsion" is used herein to refer to nanostructured PCMs comprising a first agent that undergoes an endothermic phase transition at a desired transition temperature and a second agent that assists in maintaining a nanostructure, wherein the first agent is in a dispersed phase and the second agent is in a continuous phase. First agents used in PCM nanoemulsions include, for example, phase-change polymers, fatty acids and fatty acid esters. Second agents used in PCM nanoemulsions include, for example, surfactants, emulsifiers, binders, and film-forming or non-phase change polymers.

A temperature stabilizing range can include a specific transition temperature or a range of transition temperatures. In some instances, a nanostructured PCM can be capable of inhibiting heat transfer during a period of time when the phase-change material is absorbing or releasing heat, typically as the phase-change material undergoes a transition between two states. This action is typically transient and will occur until a latent heat of the phase change material is absorbed or released during a heating or cooling process. Heat can be stored or removed from a phase-change material, and the phase-change material typically can be effectively recharged by a source emitting or absorbing it. For certain embodiments, a phase-change material can include a mixture of two or more phase-change polymers. By selecting two or more different phase-change polymers and forming a mixture, a temperature stabilizing range can be adjusted for any desired application. The resulting mixture of phase-change polymers can exhibit two or more different transition temperatures or a single modified transition temperature when incorporated in the nanostructured PCMs and articles described herein.

As used herein, the term "polymer" refers to a material that includes a set of macromolecules. Macromolecules included in a polymer can be the same or can differ from one another in some fashion. A macromolecule can have any of a variety of skeletal structures, and can include one or more types of monomeric units. In particular, a macromolecule can have a skeletal structure that is linear or non-linear. Examples of non-linear skeletal structures include branched skeletal structures, such those that are star branched, comb branched, or dendritic branched, and network skeletal structures. A macromolecule included in a homopolymer typically includes one type of monomeric unit, while a macromolecule included in a copolymer typically includes two or more types of monomeric units. Examples of copolymers include statistical copolymers, random copolymers, alternating copolymers, periodic copolymers, block copolymers, radial copolymers, and graft copolymers.

In some instances, a reactivity and a functionality of a polymer can be altered by addition of a set of functional groups, such as acid anhydride groups, amino groups and their salts, N-substituted amino groups, amide groups, carbonyl groups, carboxy groups and their salts, cyclohexyl epoxy groups, epoxy groups, glycidyl groups, hydroxy groups, isocyanate groups, urea groups, aldehyde groups, ester groups, ether groups, alkenyl groups, alkynyl groups, thiol groups, disulfide groups, silyl or silane groups, groups based on glyoxals, groups based on aziridines, groups based on active methylene compounds or other b-dicarbonyl compounds (e.g., 2,4-pentandione, malonic acid, acetylacetone, ethylacetone acetate, malonamide, acetoacetamide and its methyl analogues, ethyl acetoacetate, and isopropyl acetoacetate), halo groups, hydrides, or other polar or H bonding groups and combinations thereof. Such functional groups can be added at various places along the polymer, such as randomly or regularly dispersed along the polymer, at ends of the polymer, on the side, end or any position on the crystallizable side chains, attached as separate dangling side groups of the polymer, or attached directly to a backbone of the polymer. Also, a polymer can be capable of cross-linking, entanglement, or hydrogen bonding in order to increase its mechanical strength or its resistance to degradation under ambient or processing conditions.

As can be appreciated, a polymer can be provided in a variety of forms having different molecular weights, since a molecular weight (MW) of the polymer can be dependent upon processing conditions used for forming the polymer. Accordingly, a polymer can be referred to as having a specific molecular weight or a range of molecular weights. As used herein with reference to a polymer, the term "molecular weight (MVV)" can refer to a number average molecular weight, a weight average molecular weight, or a melt index of the polymer.

As used herein, the term "chemical bond" refers to a coupling of two or more atoms based on an attractive interaction, such that those atoms can form a stable structure. Examples of chemical bonds include covalent bonds and ionic bonds. Other examples of chemical bonds include hydrogen bonds and attractive interactions between carboxy groups and amine groups. As used herein, the term "covalent bond" means a form of chemical bonding that is characterized by the sharing of pairs of electrons between atoms, or between atoms and other covalent bonds. Attraction-to-repulsion stability that forms between atoms when they share electrons is known as covalent bonding. Covalent bonding includes many kinds of interactions, including sigma-bonding, pi-bonding, metal-metal bonding, agostic interactions, and three-center two-electron bonds.

As used herein, the term "reactive function" means a chemical group (or a moiety) capable of reacting with another chemical group to form a covalent or an electrovalent bond, examples of which are given above. Preferably, such reaction is doable at relatively low temperatures, e.g. below 200° C., more preferably below 100° C., and/or at conditions suitable to handle delicate substrates, e.g. textiles. A reactive function could have various chemical natures. For example, a reactive function could be capable of reacting and forming electrovalent bonds or covalent bonds with reactive functions of various substrates, e.g., cotton, wool, fur, leather, polyester, or textiles made from such materials, as well as other base materials.

"Polymerization" is a process of reacting monomer molecules together in a chemical reaction to form three-dimensional networks or polymer chains. Many forms of polymerization are known, and different systems exist to categorize them, as are known in the art.

As used herein, "substantially adversely affecting heat capacity or heat absorption" refers to reducing heat capacity or heat absorption by more than about 30%. Thus, a second agent or a nanocrystalline filler which does not substantially adversely affect, attenuate or reduce heat capacity or heat absorption, should be understood to adversely affect, attenuate or reduce heat capacity or heat absorption by no more than about 30%. In an embodiment, a second agent or a nanocrystalline filler adversely affects, attenuates or reduces heat capacity or heat absorption by no more than about 10%, about 20%, or about 30%. In one embodiment, a second agent or a nanocrystalline filler adversely affects, attenuates or reduces heat capacity or heat absorption by no more than about 15-25 J/g. In another embodiment, a second agent or a nanocrystalline filler adversely affects, attenuates or reduces heat capacity or heat absorption by no more than about 25 J/g.

In some embodiments, a second agent or a nanocrystalline filler enhances or increases heat capacity or heat absorption by about 5%, about 10%, about 20%, about 30%, or by about 15-30 J/g.

In some embodiments, modification or acylation of a polymer, e.g., a film-forming polymer, enhances or increases heat capacity or heat absorption of the polymer. For example, modification or acylation may increase heat capacity or heat absorption of the polymer by about 10%, about 20%, about 25%, about 30%, or about 40%.

In an embodiment, porosity is induced in a nanostructured, e.g., a nanocomposite, PCM. Porosity may be induced using various techniques known in the art, including but not limited to foaming, addition of salts, mixed solvents and temperature-induced phase separation. A resulting porous nanocomposite may allow for better air circulation, thus enhancing thermal management.

First Agents

As used herein, a "first agent" refers to an agent that undergoes an endothermic phase transition, e.g., that absorbs a significant amount of heat, in a desired temperature range or at a desired transition temperature. Non-limiting examples of first agents for use in thermoregulatory coatings include phase-change polymers, fatty acids, fatty acid esters, low-melting small molecules, and mixtures or combinations thereof. An endothermic phase transition may be a coil-to-globule transition, a crystalline-amorphous melting transition, or a solid-solid phase transition. It should be understood that any low-melting molecule, e.g., any molecule undergoing a phase transition at a desired transition temperature (e.g., 1-6° C., 30-39° C., 35-37° C., 25-30° C., 20-24° C., 19-24° C., 35-40° C., 33-40° C., or 60-80° C.) can be used as a first agent in nanostructured PCMs.

In an embodiment, a first agent undergoes an endothermic phase transition which is a solid-solid phase transition or a coil-to-globule transition or a crystalline-amorphous transition. In another embodiment, the transition temperature is 1-6° C., 30-39° C., 35-37° C., 19-24° C., 20-24° C., 25-30° C., 35-40° C., 33-40° C., or 60-80° C. In an embodiment, 50-200 J/g of heat is absorbed or released during a solid-solid phase transition. In another embodiment, about 50-200 J/g, at least about 50 J/g, at least about 100 J/g, at least about 150 J/g, or at least about 200 J/g of heat is absorbed or released during a solid-solid phase transition. In an embodiment, heat absorption of a first agent, e.g., a phase-change polymer, is not substantially adversely affected by a second agent, e.g., by a nanocrystalline filler. In another embodiment, a second agent, e.g., a nanocrystalline filler, enhances heat absorption of a first agent, e.g., a phase change polymer, for example by increasing heat absorption by at least about 10%, or by at least about 5-10%.

Phase-change Polymers

As used herein, "phase-change polymer" refers to a polymer that undergoes an endothermic or exothermic phase change within a specific temperature range. Many types of phase-change polymers are known and may be used in nanostructured PCMs. In an embodiment, low-melting polymers such as Poly(ethylene glycol) or Poly(caprolactone), which undergo a melting transition at temperatures ranging from 15° C. to 65° C., are used. In another embodiment, temperature-responsive or thermosensitive polymers that display reverse solubility in water are used. Temperature-responsive or thermosensitive polymers are hydrophilic at low temperatures, but turn hydrophobic at a critical temperature known as the Lower Critical Solution Temperature (LOST). In an embodiment, phase-change polymers display a coil-to-globule transition at the LOST. The coil-to-globule transition is an endothermic phase transition and leads to significant heat absorption, generally in the range of about 50-200 J/g.

Many polymers display a coil-to-globule transition. Non-limiting examples of such polymers include Poly(N-isopropylacrylamide), Hydroxypropyl methylcellulose (HPMC), and Poly (diethylacrylamide). Any polymer undergoing an endothermic coil-to-globule transition at a desired LOST temperature may be used in nanostructured PCMs. In an embodiment, a phase-change polymer for use in a nanostructured PCM is a low-melting polymer such as PEG or Poly(caprolactone) (PCL). In another embodiment, a phase-change polymer for use in a nanostructured PCM is a temperature-responsive polymer with an LOST such as Poly N-isopropylacrylamide (PNIIPAM) or HPMC.

Any phase-change polymer that undergoes a phase transition at a desired transition temperature, e.g., melting point or LOST temperature, may be used in nanostructured PCMs. In an embodiment, any temperature-responsive polymer that undergoes a solid-solid phase transition at a desired LOST temperature may be used in nanostructured PCMs. It will be understood therefore that the choice of phase-change polymer will depend on several factors, such as the intended application of the nanostructured PCM and the desired transition temperature, e.g., LOST, for that application.

In an embodiment, phase-change polymers for use in nanostructured PCMs absorb about 50-200 J/g of heat during a coil-to-globule transition at 30-39° C. In another embodiment, phase-change polymers for use in nanostructured PCMs absorb at least about 50 J/g, at least about 100 J/g, or at least about 150 J/g of heat during a coil-to-globule transition at 30-39° C. In a further embodiment, phase-change polymers for use in nanostructured PCMs absorb about 50-200 J/g, at least about 50 J/g, at least about 100 J/g, or at least about 150 J/g of heat during a coil-to-globule transition at 35-37° C. In a still further embodiment, phase-change polymers for use in nanostructured PCMs absorb about 50-200 J/g, at least about 50 J/g, at least about 100 J/g, or at least about 150 J/g of heat during a coil-to-globule transition at 33-40° C. In yet another embodiment, phase-change polymers for use in nanostructured PCMs absorb about 50-200 J/g, at least about 50 J/g, at least about 100 J/g, or at least about 150 J/g of heat during a coil-to-globule transition at 25-30° C. In yet another embodiment, phase-change polymers for use in nanostructured PCMs absorb about 50-200 J/g, at least about 50 J/g, at least about 100 J/g, or at least about 150 J/g of heat during a coil-to-globule transition at 20-24° C. In an embodiment, phase-change polymers for use in nanostructured PCMs absorb about 50-200 J/g, at least about 50 J/g, at least about 100 J/g, or at least about 150 J/g of heat during a coil-to-globule transition at 35-40° C. In a still further embodiment, phase-change polymers for use in nanostructured PCMs absorb about 50-200 J/g, at least about 50 J/g, at least about 100 J/g, or at least about 150 J/g of heat during a coil-to-globule transition at 1-6° C. In a still further embodiment, phase-change polymers for use in nanostructured PCMs absorb about 50-200 J/g, at least about 50 J/g, at least about 100 J/g, or at least about 150 J/g of heat during a coil-to-globule transition at 60-80° C.

It is well-known in the art that the LOST of a temperature-responsive polymer can be adjusted to a desired temperature range through copolymerization with more hydrophilic polymers or hydrophobic polymers, to increase or decrease LOST, respectively. For example, LOST can be adjusted to a desired range, e.g., 1-6° C., 30-39° C., 35-37° C., 25-30° C., 20-24° C., 35-40° C., 33-40° C., or 60-80° C. through copolymerization with more hydophilic or hydrophobic polymers, as appropriate. It should be understood that phase-change polymers for use in nanostructured PCMs include any combination of polymers undergoing a coil-to-globule transition at the desired LOST temperature range and providing a desired amount of heat absorption.

In an embodiment, phase-change polymers used in nanostructured PCMs maintain their solid state during the coil-to-globule phase transition, as evidenced, e.g., through rheological measurements. Thus, nanostructured PCMs undergo a solid-solid phase transition, in contrast to previously known PCMs which undergo other phase transitions, such as solid-liquid transitions. A solid-solid phase transition provides several advantages over previously known PCMs. For example, one or more of the following advantages may be provided: encapsulating agents are not needed in a nanostructured PCM; a higher loading ratio of phase-change polymer or nanostructured PCM (grams of phase-change polymer or PCM per substrate area) is obtained on a substrate; higher heat absorption is obtained on a substrate; there is no or minimal loss of heat capacity or heat absorption by a phase-change polymer; and/or energy-dense nanostructured PCMs that provide maximal heat absorption using minimal quantities of material are obtained; and for paper, wetting of the paper is avoided.

In an embodiment, a phase-change polymer undergoes a phase transition, e.g., a coil-to-globule transition or a solid-solid phase transition, at a desired transition temperature. In some embodiments, the presence of nanofillers ensures that nanocomposite PCMs maintain their solid state through the transition. Thus, in some embodiments, a nanostructured PCM comprises a first agent, e.g., a phase-change polymer, that undergoes a solid-solid phase transition or coil-to-globule phase transition at 30-39° C., 35-37° C., 20-25° C., 20-24° C., 25-30° C., 35-40° C., or 33-40° C. Any phase-change polymer having the property of undergoing a solid-solid phase transition or coil-to-globule phase transition at 30-39° C., 35-37° C., 20-25° C., 20-24° C., 25-30° C., 35-40° C., or 33-40° C. is contemplated for use in nanostructured PCMs.

In one embodiment, a phase-change polymer for use in a nanostructured PCM is PEG. for example, a phase-change polymer for use in a nanostructured PCM may be PEG1000, i.e., PEG of average molecular weight (MVV) of 1000. In another embodiment, PEG950-1050 is used. In another embodiment, PEG900, PEG1100, or PEG1150 is used. In another embodiment, PEG 20K (i.e., PEG 20,000) is used. In another embodiment, PEG900-20K is used. In another embodiment, PEG of different molecular weights is mixed to give a PEG composition having a desired LOST temperature. It should be understood that PEG of any molecular weight, or any mixture of PEG of different molecular weights, may be used, as long as the resulting PEG or PEG mixture undergoes a solid-solid phase transition when reinforced with a nanocrystalline filler, e.g., nanoparticles, as described herein, at the desired transition temperature. In an embodiment, a PEG or PEG mixture which undergoes a solid-solid transition at 30-39° C., 35-37° C., 20-25° C., 20-24° C., 25-30° C., 35-40° C., or 33-40° C. is used.

In an embodiment, a phase-change polymer is poly(ethylene glycol) (PEG). PEG may be, for example, PEG400, PEG500, PEG600, PEG650, PEG800, PEG900, PEG950, PEG1000, PEG1050, PEG1500, PEG2000, PEG2500, PEG3000, PEG3500, or PEG20,000. Alternatively, PEG may be a mixture of PEG of different molecular weights selected such that the PEG mixture undergoes a solid-solid phase transition at a desired transition temperature. In another embodiment, PEG may be mixed with other components selected such that the mixture undergoes a phase transition at a desired temperature; for example, a mixture of PEG with a freezing point depressant such as glycerol may be used, to obtain a desired transition temperature for the phase-change polymer.

In another embodiment, a phase-change polymer has the following structure:

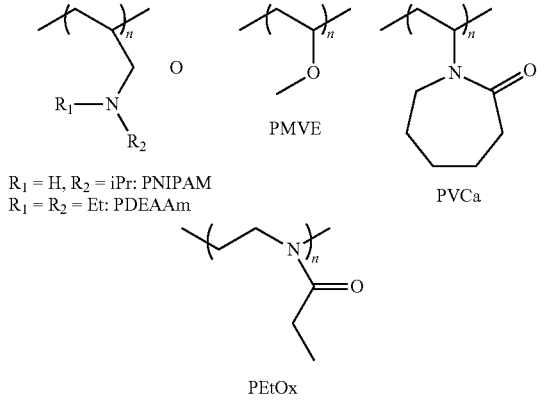

-continued

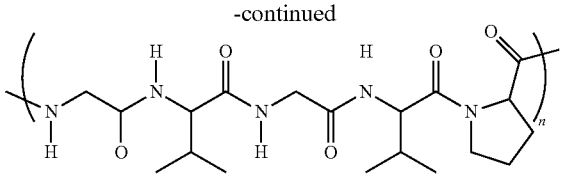

P(GVGVP)

wherein n is selected such that the phase-change polymer undergoes a solid-solid phase transition at a desired transition temperature, or such that the polymer has a desired LOST for a coil-to-globule phase transition. In an embodiment, n is selected to provide a polymer that undergoes a solid-solid or coil-to-globule phase transition at 1-6° C. 30-39° C., 35-37° C., 20-25° C., 20-24° C., 25-30° C., 35-40° C., 33-40° C., or 60-80° C. In another embodiment, n is selected such that the phase-change polymer undergoes a solid-solid phase transition at about 1-6° C., 19-24° C., 30-39° C., 35-37° C., 20-24° C., 25-30° C., 35-40° C., 33-40° C., or 60-80° C. It should be understood that n will be determined based on the desired size (i.e., molecular weight) and enthalpic properties of the polymer in question. Generally, n represents the degree of polymerization of a polymer, and can range from as low as 40 to as high as 5000. In one embodiment, $1<n<1000$. In another embodiment, 1 $40<n<1000$. In yet another embodiment, $40\leq n\leq 5000$. In an embodiment, n is 10, 20, 30, 40, 50, 60, 60, 80, 90 or 100. For example, in the case of PEG7000, n is 49.

The following abbreviations are used herein: PNIPAM stands for Poly(N-isopropylacrylamide); PDEAAm for poly (N,N-diethylacrylamide); PMVE for Perfluoromethylvinylether; PVCa for Polyvinylcaprolactam; PEtOx for Poly(2-ethyl-2-oxazoline); and P(GVGVP) for a polypeptide with the sequence Glycine, L-Valine, Glycine, L-Valine, L-Proline.

In an embodiment, two or more phase-change polymers may be combined together to achieve the desired phase change and/or heat absorption properties. For example, PEG may be combined with another polymer, such as poly(vinyl alcohol) to produce a thermally-resistant blend. In this case, the PEG-based phase-change polymer undergoes a phase change in the presence of the PVA, ensuring a solid-solid phase change. In another embodiment, PEG is combined with organic esters, producing a phase-change polymer that undergoes multiple phase transitions (e.g., conformational change, melting) in a desired temperature range. For example, PEG may be combined with hydroxypropyl cellulose with chemically grafted sucrose esters. Due to multiple phase transitions, a higher overall heat absorption may be achieved. In an embodiment, at least 200 J/g or at least 250 J/g of heat is absorbed overall from multiple phase transitions. Further, due to the energy density of this material, a relatively low loading capacity may be achieved, e.g., a loading ratio of no more than 10 grams nanostructured PCM/m$^2$, no more than 20 grams nanostructured PCM/m$^2$, no more than 30 grams nanostructured PCM/m$^2$, no more than 40 grams nanostructured PCM/m$^2$, no more than 50 grams nanostructured PCM/m$^2$, or no more than 60 grams nanostructured PCM/m$^2$ of substrate.

In another embodiment, a phase-change polymer, e.g., PEG, is complexed with polyols (also referred to herein as polyalcohols or polyalcohol compounds) to enhance heat properties and shift the peak of the transition temperature. For example, a first agent may comprise poly(ethylene glycol) complexed with a low-molecular weight Polyol, such as one of those shown in Table 1.

TABLE 1

Non-limiting examples of Polyalcohol compounds for use with a phase-change polymer such as PEG in a first agent.

| Polyalcohol names | Compound structure | Solid-solid transition temperature (° C.) |
|---|---|---|
| Pentaerythritol<br>2,2-Bis(hydroxymethyl)-1,3-propanediol | 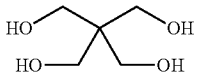 | 187-188 |
| 1,1,1-Tris(hydroxymethyl)ethane<br>2-Hydroxymethyl-2-methyl-1,3-propanediol<br>Trimethylolethane<br>Pentaglycerine | 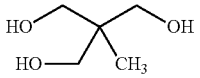 | 81-89 |
| 2,2-Dimethyl-1,3-propanediol<br>Neopentylglycol<br>NPG Glycol | 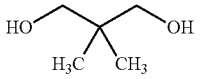 | 40-48 |
| 2-Amino-2-methyl-1,3-propanediol<br>Aminoglycol<br>Ammediol<br>AMPD | 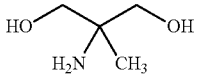 | 78 |
| 2-Amino-2-(hydroxymethyl)-1,3-propanediol<br>Tris(hydroxymethyl)aminomethane<br>Tris base<br>Trometamol<br>THAM | 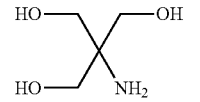 | 134.5 |

Other non-limiting examples of phase-change polymers for use in nanostructured PCMs include: polyethylene glycol, polypropylene glycol, polytetramethylene glycol, Poly (N-isopropyl acrylamide), Poly(diethyl acrylamide), Poly (tert-butylacrylate), Poly(isopropyl methacrylamide), Hydroxypropyl cellulose, Hydroxymethyl cellulose, Poly (oxazoline), and Poly(organophosphazenes). Other examples of phase-change polymers are as follows:

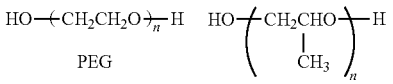

PEG

PPG

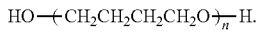

PTMEG

In another embodiment, a phase-change polymer is pluronic.

Second Agents

As used herein, a "second agent" refers to an agent that maintains a nanostructure. Non-limiting examples of second agents for use in thermoregulatory coatings include nanocrystalline fillers having a high aspect ratio (in the case of a nanocomposite PCM), or emulsifiers, surfactants, film-forming polymers, binders, or combinations thereof (in the case of a PCM nanoemulsion). In either case, the second agent serves to assist in maintaining or reinforcing a nanostructure in at least one of the phases. In some embodiments, a second agent may enhance film-forming properties and/or mechanical properties of a nanostructured PCM. In some embodiments, a second agent may facilitate, enhance, help to form, and/or help to maintain a nanostructure in a nanostructured PCM. In an embodiment, a second agent may provide mechanical reinforcement for a phase-change polymer. In another embodiment, a second agent does not substantially adversely affect heat absorption of a first agent, e.g., a phase-change polymer, in a nanostructured PCM. In an embodiment, a second agent may increase heat absorption of a first agent, e.g., a phase-change polymer, in a nanostructured PCM.

In some embodiments, a second agent can enhance the thermal management properties of a first agent in a nanostructured PCM. For example, this could occur where a second agent is a filler such as ZnO nanowires that reflect heat or such as aluminium oxide that scavenges oxygen.

In an embodiment, second agents have a high surface area to volume ratio. In an embodiment, nanocrystalline fillers have a high aspect ratio. As used herein, "aspect ratio" refers to the proportional relationship between the length and the width of a single particle of material. As used herein, "high aspect ratio" means an aspect ratio of at least about 20:1. In an embodiment, second agents or nanocrystalline fillers have an aspect ratio of at least about 20:1, at least about 25:1, at least about 30:1, at least about 35:1, at least about 40:1, at least about 45:1, at least about 50:1, or at least about 55:1. In another embodiment, second agents or nanocrystalline fillers have an aspect ratio of about 20:1, about 25:1, about 30:1, about 35:1, about 40:1, about 45:1, about 50:1, or about 55:1.

Protective Layers

As used herein, the term "protective layer" refers to a layer of a coating applied to a substrate below or on top of a nanostructured PCM, i.e., a topcoat or a basecoat. In some embodiments, a protective layer prevents a nanostructured PCM from migrating towards the paper or saturating the paper during coating from solution, drying (e.g., with heat), paper application, lamination and/or corrugation. In some embodiments, a protective layer prevents a nanostructured PCM from giving a greasy look or feel to a coated substrate, e.g., paper. It should be understood that one or more protective layers may be used in a thermoregulatory coating. For example, a thermoregulatory coating may comprise a basecoat, a topcoat, or both a basecoat and a topcoat. When multiple layers are applied, there may be more than one topcoat in a coating or a coated substrate or article.

In some embodiments, a protective layer comprises a film-forming polymer. Non-limiting examples of film-forming polymers for use in protective layers include chitosan, poly(vinyl alcohol) (PVA), poly(vinylpyrollidone) (PVP), poly(ethylene glycol) (PEG), polysaccharides, polyamines, and amphiphilic polymers that undergo a hydrophobic-hydrophilic transition at a temperature of at least about 60° C. or of about 60 to about 80° C. In some embodiments, a film-forming polymer is hydrophobically modified, for example through acetylation of side-chain pendant hydroxyl groups, for example using chloride derivatives of fatty acid esters. Non-limiting examples of such chloride derivatives of fatty acid esters include palmitoyl chloride, lauroyl chloride, myristoyl chloride and stearoyl chloride. In some embodiments, acetylation of side-chain pendant hydroxyl groups increases heat absorption of the film-forming polymer, for example by about 10%, about 20%, about 25%, about 30%, or about 40%. In an embodiment, the hydrophobically modified film-forming polymer is acetylated PVA, e.g., PVA acetylated using lauroyl chloride, e.g., lauroyl chloride 50 K or lauroyl chloride 186 K.

It will be appreciated by the skilled artisan that a protective layer may be selected based on the nanostructured PCM being used and/or the substrate being coated. For example, in the case of a hydrophilic PCM nanoemulsion, it may be desirable to use a hydrophobically-modified polymer as a protective layer. In contrast, when a nanocomposite PCM is used, it may be desirable to use a hydrophilic film-forming polymer. In some embodiments, a film-forming base coat comprises PVA or PVP. In some embodiments, a film-forming topcoat comprises an amphophilic polymer that undergoes a hydrophobic-hydrophilic transition at temperatures of about 60 to about 80° C., e.g., during a paper drying process, thus preventing a nanostructured PCM from migrating into a paper substrate during drying. For example, hydroxypropyl methylcellulose (e.g., a 5% solution) or a combination of poly(N-isopropylacrylamide and acrylic acid may be used as a topcoat. In some embodiments, a protective layer comprises a 5% hydroxypropyl methylcellulose solution in water having a transition temperature of about 70-80° C. In some embodiments, a protective layer comprises acetylated chitosan or acetylated PVA. In some embodiments, a protective layer is a basecoat comprising a positively charged polyelectrolyte that adheres well to negatively charged paper.

In some embodiments, thermoregulatory coatings for paper comprise a nanostructured PCM, e.g., a PCM nanoemulsion or nanocomposite PCM, and at least one protective layer. In some embodiments, such coatings can be directly applied onto paper, e.g., through wet-end processing or dry processing. In some embodiments, such coatings are applied onto a formed paper substrate. In some embodiments, a nanostructured PCM may bind to a substrate (e.g., a paper) via simple adhesion, without requiring the presence of a fixative or a crosslinking agent.

In some embodiments, thermoregulatory coatings for paper comprise a nanostructured PCM, e.g., a PCM nanoemulsion or nanocomposite PCM, in combination with at least one protective layer, e.g., a basecoat and/or a topcoat. For example, a basecoat may be applied first to the substrate, followed by application of the nanostructured PCM on top of the basecoat layer. Alternatively, the nanostructured PCM may be applied first to the substrate, followed by application of a topcoat on top of the nanostructured PCM layer. In some embodiments, a basecoat may be applied first to the substrate, followed by a nanostructured PCM, followed by a topcoat. A basecoat and a topcoat may be the same or different from each other.

In some embodiments, a basecoat and/or a topcoat provides a protective layer for a substrate, for example by preventing a nanostructured PCM from saturating the substrate. For example, in the case of paper, high temperatures used for drying can allow a nanostructured PCM to permeate the pores of the paper, saturating it and preventing subsequent coats, as well as preventing the conversion of such paper into a box via lamination, corrugation or simple linings. Preventing a nanostructured PCM from saturating the substrate may also be necessary to preserve the substrate's dry, grease-free properties. In some embodiments, a basecoat and/or a topcoat provides a protective layer for a nanostructured PCM, for example to allow the PCM to withstand the high temperatures and/or high pressures used during lamination of a substrate.

In some embodiments, a basecoat and/or a topcoat comprises a polymer whose backbone contains side chain pendant hydroxyl groups. Any polyol with a side chain pendant hydroxyl group may be used as a basecoat or topcoat. Non-limiting examples of such polymers include chitosan, poly(vinyl alcohol) (PVA), poly(vinylpyrollidone) (PVP), side chain poly(ethylene glycol) (PEG), polysaccharides, and polyamines; for use as a basecoat or a topcoat, such polymers are hydrophobically modified, e.g., by acetylation using a chloride derivative of a fatty acid ester. Non-limiting examples of such fatty acid esters include palmitoyl chloride, lauroyl chloride, myristoyl chloride and stearoyl chloride. A hydrophobically-modified polymer is typically dissolved in a suitable solvent (such as acetone, n-methyl pyrrolidone, ethanol, water, a mix of solvents, etc.) before coating onto a substrate or on top of a nanostructured PCM coat.

In some embodiments, a basecoat is a positively charged polyelectrolyte that adheres well to negatively charged paper. For example, a basecoat may comprise hydroxypropyl methylcellulose (HPMC), PVA, PVP or PVC.

In some embodiments, a topcoat comprises a nanocomposite PCM, such as high molecular-weight PEG.

In some embodiments, a polymer-based topcoat as described herein is capable of acting as a glue during lamination.

PCM Nanoemulsions

The term "PCM nanoemulsion," as used herein, refers to a PCM comprising a continuous phase having no heat-absorbing properties of its own, and a dispersed phase comprising droplets comprising at least one first agent that undergoes an endothermic phase transition, such as fatty acid esters, fatty acids, low molecular weight phase change polymers, phase-change polymers, or low-melting small molecules. This is in contrast to nanocomposite PCMs in which the first agent is in the continuous phase rather than the dispersed phase. In an embodiment, a PCM nanoemulsion comprises a first agent such as a mixture of fatty acid esters encapsulated in nanodroplets through high-speed shear mixing and stabilized by an emulsifier such as sodium caseinate.

Nanoemulsions are generally thermodynamically unstable emulsions formed through shear mixing at high pressures and mixing speeds to form droplets between 50-500 nm. They differ from other nanocomposite PCMs described herein, in that the phase-change component (the first agent) is in the dispersed phase rather than the continuous phase. Nanoemulsions generally behave like visoelastic solids at a critical radius and volume fraction of the dispersed phase. Further, this property is not disturbed by slight temperature changes, and viscosity of a nanoemulsion can be changed through shear.

In an embodiment, the dispersed phase of a PCM nanoemulsion forms droplets of about 200 nm or less when mixed under high shear, and an emulsifier, e.g., sodium caseinate, forms a thin interfacial layer around the droplets. At a critical particle size and a critical concentration, the PCM nanoemulsion assumes solid or solid-like properties, and the PCM nanoemulsion remains solid-like when heated to its transition temperature. The continuous (non-dispersed) phase (comprising, e.g., a non phase-change polymer substrate, a film-forming polymer substrate, a surfactant, and/or an emulsifier) is responsible for the PCM nanoemulsion maintaining a solid or solid-like phase throughout the phase transition and does not affect the overall enthalpy of the phase transition. In an embodiment, no more than 5% of the continuous phase is required in the PCM nanoemulsion.

In an embodiment, a PCM nanoemulsion has a dispersed phase comprising a first agent, e.g., a phase-change polymer, a low-molecular weight phase-change polymer, a mixture of fatty acid esters, etc., that melts in a desired temperature range to absorb large quantities of heat. In an embodiment, the dispersed phase of a PCM nanoemulsion forms droplets of about 200 nm or less when mixed under high shear, and an emulsifier, e.g., sodium caseinate, forms a thin interfacial layer around the droplets. At a critical particle size and a critical concentration, the PCM nanoemulsion assumes solid or solid-like properties, and the PCM nanoemulsion remains solid-like when heated to its transition temperature. The continuous (non-dispersed) phase (comprising, e.g., a polymer substrate and/or an emulsifier), together with the nanoscale domains and a certain critical volume fraction of the dispersed phase, is responsible for the PCM nanoemulsion maintaining a solid or solid-like phase throughout the phase transition and does not affect the overall enthalpy of the phase transition. In another embodiment the continuous (non-dispersed) phase (comprising, e.g., a polymer substrate and/or an emulsifier) is responsible for the PCM nanoemulsion maintaining a solid or solid-like phase throughout the phase transition and actually increases the overall enthalpy of the phase transition. In an embodiment, no more than 5% of the continuous phase is required in the PCM nanoemulsion.

In an embodiment, the continuous phase of a PCM nanoemulsion comprises an emulsifier. An emulsifier for use in a PCM nanoemulsion may be a surfactant, such as but not limited to Tween, Sodium Dodecyl Sulphate (SDS), Pectin, Egg Lecithin, Span, or a combination thereof. In another embodiment, an emulsifier for use in a PCM nanoemulsion is sodium caseinate.

In an embodiment, the dispersed phase of a PCM nanoemulsion comprises a first agent that undergoes an endothermic phase transition at a desired transition temperature. Non-limiting examples of first agents for use in PCM nanoemulsions include phase-change polymers, fatty acids, fatty acid esters, paraffins, oligomers of PEG, hydrophilic polymers, low-melting small molecules, or combinations thereof. In an embodiment, a first agent for use in a PCM nanoemulsion is a mix of fatty acid esters, e.g., methyl palmitate and methyl stearate. In another embodiment, a first agent for use in a PCM nanoemulsion is PEG. In another embodiment, a second agent for use in a PCM nanoemulsion (which will form the continuous phase of the nanoemulsion) is a hydophilic polymer such as poly(vinyl alcohol) (PVA), poly(vinyl pyrrolidone) (PVP), hydroxypropyl cellulose (HPC), or chitosan. In an embodiment, a PCM nanoemulsion is dispersed in a solvent such as water or a dilute solution of a hydrophilic polymer such as PVA.

In one embodiment, a PCM nanoemulsion comprises fatty acid esters stabilized with sodium caseinate and dispersed either in water or a dilute solution of a polymer such as poly(vinyl alcohol). In an embodiment, a PCM nanoemulsion comprises a first agent comprising a mix of fatty acid esters, e.g., methyl palmitate and methyl stearate, and a second agent comprising sodium caseinate. In one embodiment, the ratio of sodium caseinate: fatty acid ester (w/w) in such PCM nanoemulsions is from about 1:05 to about 1:45. In another embodiment, a PCM nanoemulsion comprises a first agent comprising a mix of 80% methyl palmitate and 20% methyl stearate and the first agent is dispersed in a water-based starch solution. In yet another embodiment, a PCM nanoemulsion comprises a first agent comprising a mix of 80% methyl palmitate and 20% methyl stearate and the first agent is dispersed in a water-based poly(vinyl alcohol) solution. In further embodiments, a PCM nanoemulsion comprises a first agent comprising a mix of fatty acid esters, e.g., 80% methyl palmitate and 20% methyl stearate, and a second agent comprising sodium caseinate, and the PCM nanoemulsion is dispersed in a water-based starch solution or a water-based poly(vinyl alcohol) solution.

In some embodiments, a second agent in a PCM nanoemulsion is sodium caseinate, modified starch or lecithin, which stabilize the particles in the dispersed phase comprising the first agent and provide, e.g., a product that can be coated onto paper. In some embodiments, a second agent in a PCM nanoemulsion is a high-melting polymer that is film-forming but that cannot in itself be used as a phase-change polymer, such as PVA. The presence of high-aspect ratio nanodroplets, formed through shear mixing, may ensure a solid state transition.

In an embodiment, the dispersed phase of a PCM nanoemulsion comprises a first agent which may be for example a fatty acid, a fatty acid ester, a paraffin, an oligomer of PEG, a hydrophilic polymer, or a combination thereof. In an embodiment, a first agent for use in a PCM nanoemulsion is a mix of fatty acid esters, e.g., methyl palmitate and methyl stearate. In another embodiment, a first agent for use in a PCM nanoemulsion is a hydrophilic polymer such as PVA, PVP, HPC, or chitosan.

A PCM nanoemulsion may be dispersed in a suitable solvent, e.g., an organic solvent or an aqueous solvent (e.g., water). A solvent is chosen by a skilled artisan based on PCMs used, desired reaction conditions, substrates or articles to be coated, and so on. Many different solvents are known and may be used with PCM nanoemulsions. Non-limiting examples include water and a dilute solution of a hydrophilic polymer.

In one embodiment, a PCM nanoemulsion comprises fatty acid esters stabilized with sodium caseinate and dispersed either in water or a dilute solution of a polymer such as Poly(vinyl alcohol) or Poly(vinyl pyrollidone).

Non-limiting examples of first agents that undergo an endothermic phase transition for use in PCM nanoemulsions include the following:

a) Fatty acid ester: glycerol derivatives, having the following general structure:

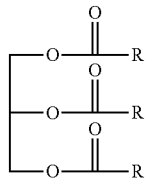

where R is an alkyl chain of general structure —$(CH_2)_n$—$CH_3$ and n is from 2 to 21;

b) PEG with acetylated fatty acid esters, such as:

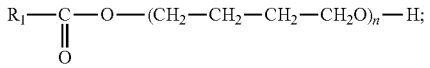

and c) PEG with acetylated fatty acid diesters, such as:

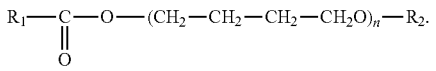

In an embodiment, a PCM nanoemulsion comprises methyl stearate and a binder. In an embodiment, a PCM nanoemulsion comprises methyl stearate and a binder in a ratio of from about 2:1 to about 3:1 methyl stearate:binder. In an embodiment, a PCM nanoemulsion comprises methyl stearate and a hycar acrylic emulsion, e.g., Hycar™ 26552. In an embodiment, a PCM nanoemulsion comprises methyl stearate and a hycar acrylic emulsion, e.g., Hycar™ 26552, in a ratio of about 2:1 to about 3:1, or about 2.3:1, methyl stearate:hycar.

Nanocomposite PCMs

The term "nanocomposite PCM," as used herein, refers to a PCM comprising at least one phase-change polymer and a nanocrystalline filler having a high surface area to volume ratio, for example a high aspect ratio, wherein the at least one phase-change polymer and the nanocrystalline filler interact together non-covalently, and wherein the phase-change polymer undergoes a solid-solid phase transition or a coil-to-globule transition at a desired transition temperature. Non-covalent interactions include but are not limited to electrostatic attractions and hydrogen bonding. In an embodiment therefore, there are provided coating compositions comprising nanocomposite phase-change materials (PCMs), i.e., comprising a phase-change polymer reinforced with nanoparticles having a high aspect ratio.

In an embodiment, a nanocrystalline filler is nanocrystalline cellulose (NCC). In another embodiment, a nanocrystalline filler is a nanocrystalline starch, a nanoclay, graphene, a carbon nanotube, an organic nanoclay, or an organoclay. For example, a nanocrystalline filler may be montmorillonite, bentonite, kaolinite, hectorite, or halloysite. In another embodiment, a nanocrystalline filler can be nanofibers of a range of polymers including, but not limited to, liquid crystalline polymers such as Poly(γ-benyzl glutamate). In an embodiment, a nanocrystalline filler may be zinc oxide particles.

In one embodiment, a nanocrystalline filler is a clay. In some embodiments, a nanocrystalline filler has a high surface area to volume ratio, e.g., a nanocrystalline filler may be spherical. In some embodiments, a nanocrytalline filler has a high aspect ratio, i.e., a high length-to-diameter ratio or a high surface area to volume ratio. In an embodiment, a high aspect ratio may be an aspect ratio of at least about 20:1, or at least about 30:1.

In an embodiment, a nanocomposite PCM comprises no more than about 5% nanocrystalline filler by weight. In another embodiment, a nanocomposite PCM comprises no more than about 3 wt %, about 5 wt %, about 8 wt %, about 5-8 wt %, about 10 wt %, or about 25 wt % of nanocrystalline filler. In yet another embodiment, a nanocomposite PCM comprises about 5 wt % to about 25 wt % nanocrystalline filler. In some embodiments, a nanocomposite PCM comprises at least about 90% or at least about 95% of phase-change polymer by weight.

In one embodiment, a nanocomposite PCM is a dispersion in a solvent, e.g., water.

In another embodiment, a nanocomposite PCM comprises a nanocrystalline filler dispersed within a phase-change polymer.

As used herein, a "nanocrystalline filler" refers to a nanocrystalline material, e.g., a nanocrytalline particle or polymer, capable of providing mechanical reinforcement to a phase-change polymer by forming a nanocomposite material. In an embodiment, a nanocrystalline filler reinforces a phase-change polymer through non-covalent physical interactions such as, without limitation, hydrogen bonds or electrostatic attractions, and without attenuating or substantially adversely affecting heat capacity or heat absorption of the phase-change polymer. In another embodiment, a nanocrystalline filler reinforces a phase-change polymer through non-covalent physical interactions such as, without limitation, hydrogen bonds or electrostatic attractions, and increases heat capacity or heat absorption of the phase-change polymer.

In one embodiment, a phase-change polymer maintains its solid state through a solid-solid, e.g., coil-to-globule, phase transition in the presence of a nanocrystalline filler. In an embodiment, a nanostructured PCM comprises a nanocomposite PCM comprising a phase-change polymer reinforced by a nanocrystalline material, wherein the phase-change polymer maintains its solid state through a coil-to-globule phase transition without substantial loss of heat capacity or heat absorption, at a desired transition temperature. In one embodiment, a nanostructured PCM comprises a nanocrystalline filler dispersed within a phase-change polymer. In another embodiment, a nanostructured PCM is dispersed in a solvent, e.g., water.

In an embodiment, a nanostructured PCM is a nanocomposite PCM formed between a phase-change polymer and a nanocrystalline filler through non-covalent physical interactions such as hydrogen bonds or electrostatic attractions between the phase-change polymer and the nanocrystalline filler. Without wishing to be bound by theory, it is believed that a nanocrystalline filler provides mechanical reinforcement to a phase-change polymer through non-covalent physical interactions with the phase-change polymer, such as, without limitation, hydrogen bonds or electrostatic attractions. This mechanical reinforcement ensures that a phase-change polymer maintains its solid state through a phase transition without attenuating its heat capacity. In some embodiments, mechanical reinforcement can increase heat capacity or heat absorption of a phase-change polymer.

It is intended that heat capacity or heat absorption of a phase-change polymer is not substantially affected by interaction with a second agent, e.g., a nanocrystalline filler, so as not to adversely affect the thermoregulatory properties of a resulting nanostructured PCM. In some cases, however, heat capacity or heat absorption of a phase-change polymer is affected advantageously, e.g., increased, by interaction with a nanocrystalline filler. For example, in some embodiments an increase in heat capacity of, e.g., up to 10%, has been observed after adding nanocrystalline filler to a phase-change polymer. Accordingly, second agents, e.g., nanocrystalline fillers which can form a nanocomposite with a phase-change polymer but do not substantially adversely affect, e.g., do not substantially reduce or attenuate, heat capacity or heat absorption of the phase-change polymer are intended to be encompassed. In some embodiments, second agents, e.g, nanocrystalline fillers which increase heat capacity or heat absorption of the phase-change polymer are encompassed. In an embodiment, second agents, e.g., nanocrystalline fillers which reduce or attenuate heat capacity or heat absorption of a phase-change polymer, for example by covalently bonding or grafting to a phase-change polymer such that its heat absorption properties are changed, are excluded from embodiments of the invention.

In an embodiment, a nanocrystalline filler is a nanocrystalline polymer. Many nanocrystalline and semi-crystalline polymers are known and may be used as nanocrystalline fillers in PCMs. In an embodiment, a cellulose-based polymer is used as a nanocrystalline filler. Examples of cellulose-based polymers include hydroxypropyl cellulose (HPC), microcrystalline cellulose (MCC) and nanocrystalline cellulose (NCC). In an embodiment, a nanocrystalline filler comprises nanocrystalline cellulose (NCC). In an embodiment, a nanocrystalline filler is not MCC, or a nanocomposite PCM does not comprise MCC.

In another embodiment, a nanocrystalline filler is a nanocrystalline starch, a nanoclay, a carbon nanotube, an organic nanoclay, an organoclay, a clay, or any electrospun polymer nanofiber. Non-limiting examples of nanocrystalline fillers for use in PCMs include montmorillonite, bentonite, kaolinite, hectorite, halloysite, and liquid crystalline polymers such as Poly(γ-benyzl glutamate). In an embodiment, a nanocrystalline filler comprises clay.

An advantage of using a nanocrystalline filler, e.g., a nanocrystalline polymer such as NCC, to mechanically reinforce phase-change polymers in nanocomposite PCMs is the ability to provide reinforcement with small quantities of nanocrystalline filler. Small quantities of nanocrystalline filler, e.g., about 5% by weight, can provide mechanical reinforcement properties equivalent to much higher amounts, e.g., about 30% by weight, of conventional fillers such as carbon fibers. This allows a nanocomposite PCM to have a higher proportion of phase-change polymer in the material, thus increasing the heat capacity of the nanocomposite PCM, and allowing a higher amount of phase-change polymer to be coated on a substrate.

In an embodiment, as little as 5% nanocrystalline filler is used; in other words, the weight of nanocrystalline filler is no more than 5% of the total weight of the nanocomposite PCM. In an embodiment, a nanocomposite PCM comprises 5% by weight nanocrystalline filler and 95% by weight phase-change polymer. In another embodiment, a nanocomposite PCM comprises about at least about 0.5 wt %, at least about 3 wt %, at least about 5 wt %, at least about 10 wt %, or at least about 15 wt % of nanocrystalline filler by weight. In another embodiment, a nanocomposite PCM comprises no more than about 3 wt %, about 5 wt %, about 8 wt %, about 10 wt %, or about 25 wt % of nanocrystalline filler. In one embodiment, a nanocomposite PCM comprises no more than 5-8 wt % of nanocrystalline filler. In an embodiment, a nanocomposite PCM comprises about 5 wt % to about 25 wt % of nanocrystalline filler. In another embodiment, a nanocomposite PCM comprises about 0.5 wt % to about 5 wt % nanocrystalline filler. In yet another embodiment, a nanocomposite PCM comprises at least 90% wt % or at least 95 wt % of phase-change polymer.

In an embodiment, a nanocomposite PCM further comprises low-molecular weight additives, e.g., fatty acids, which either enhance heat absorption or enthalpy and/or shift the transition temperature of a phase-change polymer as desired. In one embodiment, a nanocomposite PCM further comprises a freezing point depressant. Non-limiting examples of freezing point depressants include: salts such as sodium chloride, calcium chloride, potassium chloride, and magnesium chloride; ethylene glycol, glycerol, sorbitol, lactitol, sucrose, lactose, palatinol, erythritol, corn syrup, xylitol, lactose and other polyols; and fatty acids. It should be understood that many freezing point depressants are known in the art and may be used, provided their chemistry is compatible with the phase-change polymer or the nanocomposite PCM.

Thermoregulatory Coatings and Coated Papers

In some embodiments, there are provided herein thermoregulatory coatings comprising nanostructured PCMs, e.g., nanocomposite PCMs and PCM nanoemulsions, which give improved performance in terms of heat absorption compared to phase-change materials known in the art, due to the small amount of reinforcing agent required to maintain a solid-solid phase transition. Unlike conventional composites, nanostructured PCMs, e.g., nanocomposites PCMs, may need no more than, e.g., 5-10% filler. Without wishing to be bound by theory, it is believed that nanocomposite PCMs may need only small amounts of filler since the high surface area to volume (e.g., high aspect) ratio of the nanocomposite ensures a very high reinforcement surface area. The reinforcement surface area is sufficiently large that a small quantity of filler is sufficient to prevent a phase-change polymer from melting into a liquid, thereby maintaining a solid-solid phase transition. In some embodiments, thermoregulatory coatings comprise nanocomposite PCMs wherein a small quantity of filler, e.g., between about 5% and about 10%, is sufficient to ensure that a solid state is maintained post-phase transition.

Likewise, the critical nanoscale dimensions of the dispersed phase in a PCM nanoemulsion, at the right volume fraction range, will lead to a PCM nanoemulsion having solid or solid-like properties in its natural state. Thereafter, this solid-like phase is maintained through the phase transition. It will be understood by the skilled artisan that, for every specific nanoemulsion system, there is a critical particle size and volume fraction at which the nanoemulsion becomes solid or solid-like. This volume fraction range depends on the specific nanoemulsion chemistry and the ratio will be determined using standard methods, for example by varying concentration and particle size to find the right point on a phase diagram to provide the desired properties (see, e.g., McClements, D. J., Soft Matter: 7, pp. 2297-2316, 2011), which describes emergence of the solid state at a particular volume fraction).

In some embodiments, a thermoregulatory coating provided herein comprising a nanostructured PCM and a basecoat and/or a topcoat has a solids content of 85% or less. In some embodiments, a coating provided herein comprising a nanostructured PCM and a basecoat and/or a topcoat has a solids content of at least 50%, at least 55%, or at least 60%. In some embodiments, a coating provided herein comprising a nanostructured PCM and a basecoat and/or a topcoat has a solids content of from about 55% to about 85%, or from about 60% to about 85%. In some embodiments, a coating provided herein comprising a nanostructured PCM and a basecoat and/or a topcoat has a solids content of about 55% to about 65%.

In some embodiments, a nanostructured PCM is directly integrated onto paper through wet-end processing or dry processing. In an embodiment, a nanostructured PCM is used as a wet-end additive, i.e., the nanostructured PCM is introduced as an additive during the wet-end of the papermaking process, or incorporated into the pulp. In some embodiments, a nanostructured PCM is coated onto a formed paper substrate.

In some embodiments, a coating provided herein comprising a nanostructured PCM and a basecoat and/or a topcoat can withstand high temperatures and pressures used during lamination or corrugation. For example, a coating may withstand a temperature of about 60° C. or higher or about 80° C. or higher, and/or may withstand a pressure of about 400 psi or higher.

In some embodiments, a coating provided herein can be applied as a film onto the substrate. For example, a coating may adhere to the substrate in a thin layer. Typically, in this case multiple coats may be added, on top of each other, creating multilayered coats.

In some embodiments, a coating provided herein can be introduced as a water-based coating. For example, a PCM nanoemulsion can be dispersed in a water-based or aqueous solvent. A basecoat or topcoat can also be provided in a water-based or aqueous solvent. This allows provision of a water-based coating for paper.

In an embodiment, a thermoregulatory coating comprises a nanocomposite PCM, wherein the phase-change polymer is dispersed in the nanocrystalline filler to form a solid solution.

In another embodiment, a thermoregulatory coating comprises a PCM nanoemulsion, wherein the first agent that undergoes an endothermic phase transition at a desired transition temperature is in a dispersed phase, and the second agent that maintains a nanostructure is in a continuous phase.

In some embodiments, coated papers provided herein comprise about 60 to about 100 grams per square meter (GSM) of coating. In some embodiments, coated papers provided herein comprise about 10 to about 100 GSM of coating. In some embodiments, coated papers provided herein comprise about 20 to about 30 GSM of coating. In some embodiments, coated papers provided herein comprise at least about 15, at least about 20, at least about 25, or at least about 30 GSM of coating. In an embodiment, a coated paper is used to form a box, the box comprising at least about 600 GSM of coating.

In some embodiments, coated papers provided herein are recyclable and/or repulpable.

In an embodiment, a loading ratio of no more than 10 grams PCM/$m^2$, no more than 20 grams PCM/$m^2$, no more than 30 grams PCM/$m^2$, no more than 40 grams PCM/$m^2$, no more than 50 grams PCM/$m^2$, or no more than 60 grams PCM/$m^2$ of substrate is obtained. In another embodiment, a loading ratio of at least 10 grams PCM/$m^2$, at least 20 grams PCM/$m^2$, at least 30 grams PCM/$m^2$, at least 40 grams PCM/$m^2$, at least 50 grams PCM/$m^2$, or at least 60 grams PCM/$m^2$ of substrate is obtained.

In another embodiment, in order to increase thermal buffering capability, higher loading ratios are used, and/or multiple layers of coating are applied onto a substrate or article. In some embodiments, coated substrates, e.g., coated papers, provided herein comprise about 60 to about 100 grams per square meter (GSM) of coating. In some embodiments, coated papers provided herein comprise about 10 to about 100 GSM of coating. In some embodiments, coated papers provided herein comprise about 20 to about 30 GSM of coating. In some embodiments, coated papers provided herein comprise at least about 15, at least about 20, at least about 25, or at least about 30 GSM of coating. In an embodiment, a coated paper is used to form a box, the box comprising at least about 600 GSM of coating.

In some embodiments, an article comprises about 600 grams per square meter of nanostructured PCM.

In further embodiments, there are provided herein thermochromic thermoregulatory coatings that combine heat absorption and dye release or dye revelation in a single phase transition. For example, a thermoregulatory coating may comprise a dye that is released during the phase transition process concurrently with heat absorption. Dye release thus indicates that the nanostructured PCM has been activated or that a phase change has occurred. In some embodiments, a dye may be chosen such that it is released at a temperature slightly higher, e.g., at one degree higher, than the thermal plateau of the nanostructured PCM, thereby indicating that thermal buffering effect has been exhausted. In yet another embodiment, a coloured square is placed underneath a thermoregulatory coating in an article. Some first agents, such as PEG, become less opaque during the phase transition and during this change the coloured square underneath is therefore revealed.

In some embodiments, a nanostructured PCM is combined with a paper glue such as starch, modified starch or PVA to create a stable emulsion that can be directly laminated on paper. Such PCMs can be used to create paper and boxes with intrinsic thermal buffering properties.

In an aspect of the present invention, thermoregulatory coatings provided herein are used to form thermoregulatory or thermosensitive coatings on a substrate or article. In an embodiment, a thermoregulatory coating can adhere to a substrate or article, e.g., to the surface of a substrate or article. For example, a thermoregulatory coating may possess a reactive function capable of reacting and bonding with a substrate. Once coated onto a substrate, a thermoregulatory coating can provide thermoregulatory properties to the substrate. For example, a thermoregulatory coating may undergo a solid-solid phase transition at 20-24° C. to absorb heat.

Thermoregulatory coatings provided herein may comprise one nanostructured PCM layer or more than one, i.e., two or more, nanostructured PCM layers. Multiple nanostructured PCM layers in a coating may have the same or different heat absorption properties, depending for example on the composition of phase-change polymers in each nanostructured PCM layer. This can allow multiple functionalities for a coating. For example, a coating may have the capability of absorbing heat at more than one transition temperature.

In an embodiment, thermoregulatory coatings provide a solid-state thermal management system.

In an embodiment, a thermoregulatory coating has a single phase change temperature or multiple such temperatures. According to one embodiment, a thermoregulatory coating has at least one phase change temperature in the range between 25-30° C., and a phase change enthalpy of at least 50 J/g or about 50 to about 200 J/g. In another embodiment, a thermoregulatory coating has at least one phase change temperature in the range between 1-6° C. In another embodiment, a thermoregulatory coating has at least one phase change temperature in the range between 19-24° C. In another embodiment, a thermoregulatory coating has at least one phase change temperature in the range between 60-80° C. A phase change at each temperature has its own enthalpy, so that according to some embodiments, a coated substrate or article has a single phase change enthalpy and, according to other embodiments, multiple such enthalpies. As used herein, the term "overall phase change enthalpy" refers to the enthalpy of phase change in the case of an article with a single phase change temperature and to the combined enthalpies in case of an article with multiple phase change temperatures. According to an embodiment, an article has an overall phase change enthalpy of at least 50 J/g, at least 100 J/g, at least 150 J/g, at least 200 J/g, or about 50 to about 200 J/g.

In In an embodiment, a coated substrate or article is for use in packaging, e.g., for packaging food, medicines, blood products, vaccines, etc, e.g., chocolate. In an embodiment, a coated substrate is a coated paper used to construct a packaging material, such as a packaging box, used for transportation of a temperature-sensitive product such as food, blood, plasma, or other medical products. In some embodiments, coated substrates or articles provided herein are thermal packaging boxes which provide thermal protection of temperature-sensitive products during transportation. For example, a coated article may be a disposable box, e.g., a disposable paper or cardboard box, wherein a thermoregulatory coating has been directly coated onto the paper or cardboard to provide thermal protection.

A wide range of temperature-sensitive products may be thermally buffered using coated substrates or articles provided herein. For example, a temperature-sensitive product may be one or more of the following (these examples are given for illustrative purposes, and are not meant to be limiting): an electronic, an electrical article, a computer, a food, a beverage, a cosmetic, a medicine, a vaccine, a blood product, and an agricultural product.

It should be understood that thermoregulatory coatings, coated papers, and articles described herein, can be used in any application where temperature regulation, temperature buffering, temperature control or latent heat of fusion is utilized, or any phase transition phenomenon is employed. In some embodiments, thermoregulatory coatings and coated papers are used for packaging, shipping and/or transporting a temperature-sensitive product, such as an agricultural product, a biological product, a medical product, a biomedical product, or an industrial product. It should be understood that many products may benefit from thermal buffering and use of thermoregulatory coatings, coated papers, and articles described herein is not meant to be particularly limited.

Further non-limiting examples of applications include: shipping, storage or packaging containers, in the form of envelopes, sleeves, labels, cardboard, wrapping, insulation, cushioning, pads, tarps, bags, boxes, tubes, containers, sheets, films, pouches, suitcases, cases, packs, covers, baskets, drawers, drums, barrels, tubs, bins, hoppers, and totes; food packaging, food shipment, food delivery, medical shipment, medical delivery, and/or body shipment industries; medical, health, therapeutic, curative, and/or wound management articles such as bandages, wraps, wipes, tubes, bags, pouches, sleeves, foams, and pads; and building, construction, and/or interior articles where energy management and off-peak energy demand reduction is desired, such as furnishings, window treatments, window coverings, wall-board, insulation, vacuum panels, insulation boards, gypsum boards, wall boards, laminates, building wrap, and wallpaper.

In an embodiment, there is provided a method for production of an article described herein, comprising providing a nanostructured PCM, providing a substrate, providing a protective layer, and combining the nanostructured PCM with the substrate. According to one embodiment, the substrate carries at least one reactive function and the combining comprises chemically reacting a functional group of the nanostructured PCM with a functional group of the substrate. In some embodiments, a nanostructured PCM is mixed with a substrate with agitation, and a film-forming composite occurs spontaneously in the absence of crosslinking agents. It should be understood that a skilled artisan will select mixing conditions such as temperature, speed of agitation, and duration of mixing based on a number of factors, such as the nanostructured PCM being used, the substrate to be coated, etc.

In some embodiments, a nanostructured PCM can form a polymer latex-like film, where colloidal particles coalesce together with minimal or no solvent.

A nanostructured PCM can be adhered to a substrate or an article as a coating, laminate, infusion, treatment or ingredient in a coating, laminate, infusion, treatment that is formed adjacent to, on or within the substrate using any suitable coating, laminating, infusion, etc., technique. During use, a nanostructured PCM or thermoregulatory coating can be positioned so that it is adjacent to an internal compartment, thus serving as an inner coating. It is also contemplated that a nanostructured PCM can be positioned so that it is exposed to an outside environment, thus serving as an outer coating. In an embodiment, a nanostructured PCM or thermoregulatory coating covers at least a portion of a substrate or article. Depending on characteristics of the substrate or the specific coating technique that is used, a nanostructured PCM can penetrate below the top surface and permeate at least a portion of the substrate or article.

Coated substrates, e.g., papers, or articles described herein comprising thermoregulatory coatings may have a single phase change temperature or multiple phase change temperatures. It should be understood that the phase change at each of the temperatures has its own enthalpy, so that a paper or article has according to some of the embodiments a single phase change enthalpy and, according to others, multiple such enthalpies. According to an embodiment, a paper or article has an overall phase change enthalpy of about 50 to about 200 J/g, at least about 50 J/g, at least about 100 J/g, at least about 150 J/g, or at least about 200 J/g.

Thermoregulatory coatings may be applied to a substrate or article using conventional techniques, such as brushing, painting, printing, stamping, rolling, dipping, spin-coating, spraying, or electrostatic spraying. In an embodiment, solutions of nanostructured PCMs are uniformly spray coated on a substrate. In an embodiment, a thermoregulatory coating is applied onto a substrate or an article by bar coating, rod coating, flexography or rotogravure. Many such methods are known in the art and may be used to apply a thermoregulatory coating onto a substrate or article.

Thermoregulatory coatings described herein provide certain advantages in comparison to other coatings available in the art. For example, a thermoregulatory coating described herein may have one or more of the following properties: 1) it may be able to endow materials with excellent thermosensitivity or heat absorption capacity; 2) it may be used to coat a variety of different substrates and articles; 3) it may provide thermoregulatory coatings with a highly enthalpic phase change, i.e., heat absorption capacity of about 50 to about 200 J/g; 4) it may undergo a solid-solid phase transition; maintaining a solid state eliminates the need for encapsulating agents, thus allowing coatings to comprise a higher content of phase-change material or phase-change polymer, consequently providing higher heat absorption capability than other coatings available in the art; 5) it may provide a thermoregulatory coating which lasts longer than coatings known in the art, e.g., at least 30 minutes; 6) it may provide a thermoregulatory coating that is not flammable, not toxic, food-safe, and/or not irritating to the skin; 7) it may provide a thermoregulatory coating which is more cost-effective than existing coatings; and 8) it may provide a thermoregulatory coating which is reusable and/or recyclable; and 9) it may provide a thermoregulatory coating which can be incorporated into the wet-end of a papermaking process, e.g., as a wet-end additive.

As used herein, the term "substrate" is used to refer to the surface of a material, e.g., a paper, which is to be coated with, or which has been coated with, a thermoregulatory coating as described herein. In an embodiment, a substrate is a paper. Non-limiting examples of papers which may be coated include kraft paper, beehive paper, aluminium laminated paper, metallized paper, grease-proof paper, vacuum panel, board, cardboard, paperboard, foam insert, carton, and containerboard. It should be understood that many types of paper are known and may be coated using coatings and methods described herein. Further, many uses for coated papers are known, such as but not limited to use to construct boxes, packages, containers, and other such articles.

As used herein, the term "article" is used to refer to an article formed or constructed from a substrate, e.g., from a coated paper, or comprising a thermoregulatory coating described herein. Non-limiting examples of such articles include packages, packaging materials, wipes, paper containers, paper boxes, cardboard boxes, boxes for transporting materials, envelopes, vacuum insulation panels, liners, and pre-impregnated composite resins. Such articles have broad application. In one embodiment, such articles may be used for thermal buffering of temperature-sensitive products, such as, without limitation, blood bags, vaccines, medicines, milk products, meat products, foods, medicines, agricultural products, biological products, biopharmaceutical products, and industrial products. In an embodiment, an article is a material for food packaging, e.g., for packaging chocolate. It should be understood that the thermal buffering capacity of a packaging container may also be enhanced through optimizing packing, for example by minimizing void volume in the package, minimizing air pockets, and/or using additional insulators. In some embodiments, a coated paper may be added to the inside of a package to form a compartment, thus providing additional heat capacity and thermal buffering. In some embodiments, a coated paper is placed inside a package, thus providing additional heat capacity and thermal buffering.

In some embodiments, an article may undergo multiple endothermic phase transitions. In some embodiments, at least 200 J/g of heat may be absorbed overall at a transition temperature range of 1-6° C., 19-24° C., or 60-80° C.

Nanostructured PCMs and thermoregulatory coatings may be applied using any methods known in the art. Methods of application are selected by a skilled artisan based on, for example, substrate to be coated, intended application, etc. For example, coatings may be sprayed, brushed, painted, printed, stamped, screen-printed, wiped (e.g., applied to a cloth or a wipe which is used to wipe a coating onto a substrate), sponged, rolled, spin-coated or electrostatically sprayed onto a substrate, or a substrate may be dipped, submerged or soaked in a solution containing nanostructured PCMs, and so on. In some embodiments, a thermoregulatory coating is applied to a substrate using standard techniques in the art, such as bar coating, rod coating, flexography, and rotogravure.

Thermoregulatory coatings prepared using nanostructured PCMs and methods described herein can have a broad range of thicknesses, depending for example on compositions employed and application processes used. The amount of thermoregulatory coating and/or nanostructured PCM loaded onto a substrate or article can also vary. In an embodiment, the thickness of a thermoregulatory coating is from about 10 micrometers to about 100 micrometers thick. In another embodiment, a thermoregulatory coating has a thickness of about 10 micrometers, about 20 micrometers, about 30 micrometers, about 40 micrometers, about 50 micrometers, about 60 micrometers, about 70 micrometers, about 80 micrometers, about 90 micrometers, or about 100 micrometers.

In some embodiments, multiple coatings may be applied to a substrate, e.g., multiple coating layers may be applied. A thermoregulatory coating may comprise multiple layers of nanostructured PCM and/or multiple protective layers. In some embodiments, a thermoregulatory coating comprises a sandwich of layers, i.e., a nanostructured PCM layer followed by a topcoat followed by another nanostructured PCM layer followed by another topcoat, etc., with or without a basecoat below the first nanostructured PCM layer. Many such permutations are possible.

Performance of thermoregulatory coatings described herein may be measured by any of a variety of tests, which are relevant to a coating's ability to perform under a variety of circumstances. In an embodiment, nanostructured PCMs and thermoregulatory coatings described herein provide a cooling effect, due to the endothermic nature (heat absorption) of the solid-solid phase change. In some embodiments, nanostructured PCMs and thermoregulatory coatings described herein may also be used to provide a warming effect, or temperature stabilization effect (e.g., both cooling and warming effects within a fluctuating temperature range), due to the exothermic nature (heat release) of the solid-solid phase change. It will be well-understood by those of skill in the art that phase change reactions are reversible and that, depending on the nature of the temperature shift that occurs, a phase change reaction may proceed in an endothermic or an exothermic direction. Nanostructured PCMs and thermoregulatory coatings may thus be used in a wide range of applications where temperature stabilization or thermoregulation of an article or substrate is desired. Further, it will be understood that a phase change reaction may be reversed when desired, allowing reuse of thermoregulatory articles provided herein. For example, if an article has been heated such that the PCM has undergone a phase transition, the article may subsequently be cooled to reverse the phase transition, thus "recharging" the thermoregulatory coating or article and allowing reuse for thermal buffering against heat.

In some embodiments, coated papers and articles described herein are recyclable and/or repulpable. In some embodiments, coated papers and articles described herein are suitable for reuse, e.g., through cooling, the cooling reversing the solid-solid phase change of the at least one phase-change polymer in the nanostructured PCM in the thermoregulatory coating.

In some embodiments, thermoregulatory coatings described herein can withstand temperatures and/or pressures used during the paper making process, during lamination, during corrugation, and/or during conversion of a coated paper into an article such as a box, package, etc. In some embodiments, thermoregulatory coatings are stable at high temperatures and/or pressures used during lamination and/or corrugation, such as 60° C. or higher, 80° C. or higher, and/or 400 psi or higher. Thermoregulatory coatings described herein may also be UV-resistant in some embodiments. In other embodiments, coatings described herein are stable and/or durable to environmental conditions such as sun exposure, wetting, salt resistance, or the like, indicating that they can be employed in a variety of harsh environments.

Nanostructured PCMs and thermoregulatory coatings may be tested for performance, stability, durability, etc., using methods known in the art. Appropriate performance testing and parameters are selected by a skilled artisan based on several factors, such as desired properties, substrate to be coated, application, etc. In some embodiments, properties of nanostructured PCMs and thermoregulatory coatings are determined using standardized techniques known in the art, such as ASTM tests or techniques.

To coat a substrate, a nanostructured PCM may be used in a solvent, e.g., an organic solvent or an aqueous solvent (e.g., water), optionally in combination with additives. A solvent is chosen by a skilled artisan based on nanostructured PCMs used, desired reaction conditions, substrates or articles to be coated, and so on. Many different solvents are known and may be used with nanostructured PCMs. In an embodiment, a nanostructured PCM is used as a dispersion in a solvent.

In some embodiments, nanostructured PCMs are used with an additive. Additives may be used, for example, to stabilize a formulation, to provide additional functional properties, to facilitate crosslinking to a substrate or article, etc. In certain embodiments, one or more than one additive is used. Non-limiting examples of crosslinking agents to be used with nanostructured PCMs include divynilbenzene, phenol/formaldehyde, polyethylenimine, carbodiimides, isocyanates, ethylene glycol and methylenbisacrylamide. Non-limiting examples of additives to be used with nanostructured PCMs include fixatives, rheology modifiers, UV stabilizers, plasticizers, surfactants, emulsifiers, binders, antistatic additives, flame retardants, friction reduction agents, anti-blocking agents, freezing point depressants, IR reflecting agents, and lubricants. Additives and crosslinking agents are chosen by a skilled artisan based on nanostructured PCMs used, desired reaction conditions, substrates or articles to be coated, and so on.

Nanostructured PCMs and thermoregulatory coatings may take any desired shape or form, limited only by the manner and patterns in which they can be applied. In some embodiments, nanostructured PCMs and thermoregulatory coatings will completely cover a substrate or article. In other embodiments, nanostructured PCMs and thermoregulatory coatings will cover only a portion of a substrate or article, such as one or more of a top, side or bottom of the substrate or article.

As discussed above, a wide variety of articles may be coated with nanostructured PCMs and thermoregulatory coatings. Non-limiting examples of such articles include boxes, cardboard, printing paper, paper adhesive tapes, ribbons, furniture, packaging, vacuum panels, insulated vacuum panels, pre-impregnated composites or resins, and so on.

In some embodiments, a coated article's look and/or feel is substantially the same as that of an uncoated article. In some embodiments, a coated article does not look or feel greasy.

Nanostructured PCMs and thermoregulatory coatings may be applied to articles, e.g., boxes, packages, containers, etc., before manufacture, e.g., to paper from which the article is constructed, or coatings may be applied to an article after it has been constructed. In some cases, coatings may be applied by a retailer or by a consumer after purchase.

In an embodiment, nanostructured PCMs and thermoregulatory coatings provided herein are easily integrated into standard paper manufacturing processes, without requiring new machinery or extensive revisions to existing processes.

EXAMPLES

The present invention will be more readily understood by referring to the following examples, which are provided to illustrate the invention and are not to be construed as limiting the scope thereof in any manner.

Unless defined otherwise or the context clearly dictates otherwise, all technical and scientific terms used herein have the same meaning as commonly understood by one of ordinary skill in the art to which this invention belongs. It should be understood that any methods and materials similar or equivalent to those described herein can be used in the practice or testing of thermoregulatory coatings described herein.

Unless specified otherwise, PCM nanoemulsions and nanocomposite PCMs were prepared as described in International application no. PCT/CA2013/050860.

Example 1

Coating PCM Nanoemulsions on Paper

Coating compositions comprising a PCM nanoemulsion were coated onto paper as follows. It is noted that the same procedure was used for the basecoat as for the PCM nanoemulsion. The PCM nanoemulsion is also referred to here as "formulation". The basecoat used was a hydroxypropyl methylcellulose (HPMC) solution at 10% w/w. The grammage of the paper used was about 130 grams per square meter (gsm).

First, an A5-size sheet of paper was weighed. The sheet was placed on a table, and about 15-20 mL of formulation was added on top of the paper. The paper was coated by spreading the formulation using a rod #10. The coated paper was then put in an oven at 70° C. for 2 min, and then removed from the oven and left at room temperature for 20 min. to stabilize the formulation. The coated paper was weighed, and the amount of coating added to the paper was calculated in GSM (grams per square meter).

If a basecoat was used, then the basecoat was first coated on the paper using the above procedure, and then the formulation was added on top.

Twenty different PCM nanoemulsions (or "formulations") were made and tested. Formulations are listed in Tables 1A and 1B. Results from coating the formulations on paper, with and without basecoat, are given in Table 2 and FIG. 1 for four of the PCM nanoemulsion formulations: Formulation A (see Table 2); #4 (Table 1A); #12x (Table 1A); and #16 (Table 1B). Photographs of the front and back sides of the coated papers are shown in FIG. 1.

Add-on percentages obtained after one single application of formulation were between 20 and 27 gsm. It is noted that formulations coated on plain paper, in the absence of basecoat, presented higher add-on percentages than formulations coated on the HPMC basecoat. Further, a PVA basecoat maintained the same gsm of formulation (48) when compared to formulation alone without any basecoat or topcoat (50), suggesting that pickup was not reduced through the use of these coats.

Physical properties of the formulations were characterized. Results are given in Tables 3A and 3B.

TABLE 1A

PCM Nanoemulsion Formulations.

| | Weight (g) Emulsion number | | | | | | | | | | | | | | | |
|---|---|---|---|---|---|---|---|---|---|---|---|---|---|---|---|---|
| Substance | 1 | 2 | 3 | 4 | 5 | 6 | 7 | 8 | 9 | 10 | 11 | 12 | 12x | 13 | 14 | 15 |
| Type | Surfactants | | | Binders | | Fillers | | | Cross Linkers | | HPMC | | | | Fillers | |
| PVA 71-30 | 1.82 | 1.86 | 1.88 | 0.0 | 0.0 | 1.88 | 1.88 | 1.90 | 1.98 | 1.98 | 0.0 | 1.0 | 1.0 | 1.0 | 2.0 | 2.0 |
| Methyl Stearate | 25.6 | 26.0 | 26.3 | 35 | 35 | 26.3 | 26.3 | 26.9 | 26.2 | 26.2 | 25.2 | 25.2 | 25.2 | 25.2 | 25.2 | 25.2 |
| Tween 80 | 1.92 | 1.30 | 0.65 | 0.0 | 0.0 | 0.65 | 0.65 | 0.0 | 0.65 | 0.65 | 2.52 | 2.52 | 0.25 | 2.52 | 2.52 | 2.52 |
| Span 85 | 0.20 | 0.13 | 0.07 | 0.0 | 0.0 | 0.07 | 0.07 | 0.0 | 0.07 | 0.07 | 0.25 | 0.25 | 2.52 | 0.25 | 0.25 | 0.25 |
| Water | 20.5 | 20.8 | 21.1 | 0.0 | 0.0 | 21.0 | 21.0 | 21.0 | 21.0 | 21.0 | 20.0 | 20.0 | 20.0 | 20.0 | 20.0 | 20.0 |
| NCC | 0.0 | 0.0 | 0.0 | 0.0 | 0.0 | 0.1 | 0.0 | 0.0 | 0.0 | 0.0 | 0.0 | 0.0 | 0.0 | 0.0 | 0.0 | 0.0 |
| Cloisite 116 | 0.0 | 0.0 | 0.0 | 0.0 | 0.0 | 0.0 | 0.1 | 0.2 | 0.0 | 0.0 | 0.0 | 0.0 | 0.0 | 0.1 | 0.1 | 0.2 |
| Hycar 26552 | 0.0 | 0.0 | 0.0 | 15.0 | 0.0 | 0.0 | 0.0 | 0.0 | 0.0 | 0.0 | 0.0 | 0.0 | 0.0 | 0.0 | 0.0 | 0.0 |
| Hycar 2671 | 0.0 | 0.0 | 0.0 | 0.0 | 15.0 | 0.0 | 0.0 | 0.0 | 0.0 | 0.0 | 0.0 | 0.0 | 0.0 | 0.0 | 0.0 | 0.0 |
| Borax | 0.0 | 0.0 | 0.0 | 0.0 | 0.0 | 0.0 | 0.0 | 0.0 | 0.1 | 0.0 | 0.0 | 0.0 | 0.0 | 0.0 | 0.0 | 0.0 |
| PEG 400 | 0.0 | 0.0 | 0.0 | 0.0 | 0.0 | 0.0 | 0.0 | 0.0 | 0.0 | 0.1 | 0.0 | 0.0 | 0.0 | 0.0 | 0.0 | 0.0 |
| HPMC | 0.0 | 0.0 | 0.0 | 0.0 | 0.0 | 0.0 | 0.0 | 0.0 | 0.0 | 0.0 | 2.0 | 1.0 | 1.0 | 1.0 | 0.0 | 0.0 |
| PAL-MetoxyPEG | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| (PAL)2-PEG | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Total | 50 | 50 | 50 | 50 | 50 | 50 | 50 | 50 | 50 | 50 | 50 | 50 | 50 | 50 | 50 | 50 |

TABLE 1B

PCM Nanoemulsion Formulations.

| Substance Type | Weight (g) 16 | 17 Acetylated PEG | 18 | 19 Binder |
|---|---|---|---|---|
| PVA 71-30 | 1.44 | 1 | 1 | 1 |
| Methyl Stearate | 20.2 | 25 | 20 | 25.2 |
| Tween 80 | 0 | 0 | 0 | 0.5 |
| Span 85 | 0 | 0 | 0 | 0.0 |
| Water | 16.2 | 23 | 20 | 18.3 |
| NCC | 0.0 | 0 | 0 | 0.0 |
| Cloisite 116 | 0.0 | 0 | 0 | 0.0 |
| Hycar 26552 | 0.0 | 0 | 0 | 5.0 |
| Hycar 2671 | 0.0 | 0 | 0 | 0.0 |

TABLE 1B-continued

PCM Nanoemulsion Formulations.

| Substance Type | Weight (g) 16 | 17 Acetylated PEG | 18 | 19 Binder |
|---|---|---|---|---|
| Borax | 0.0 | 0 | 0 | 0.0 |
| PEG 400 | 0.0 | 0 | 0 | 0.0 |
| HPMC | 0.0 | 0 | 0 | 0.0 |
| PAL-MetoxyPEG | 2.22 | 2 | 1.5 | 0.0 |
| (PAL)2-PEG | 0.0 | 1 | 0.25 | 0.0 |
| Total | 40 | 52 | 42.75 | 50 |

TABLE 2

PCM Nanoemulsion Formulations Coated on Paper.

| Formulation | Sample | Base coat? | Paper weight (g) | Paper + basecoat (g) | Paper + basecoat + formulation | Basecoat added (gsm) | Formulation added (gsm) |
|---|---|---|---|---|---|---|---|
| A[1] | 1 | Yes | 4.17 | 4.24 | 4.88 | 2.35 | 20.01 |
| | 2 | Yes | 4.23 | 4.33 | 4.93 | 3.28 | 18.76 |
| | 3 | Yes | 4.24 | 4.43 | 5.07 | 5.94 | 20.01 |
| | | | Average | | | 3.86 | 19.60 |
| | | | Standard Deviation | | | 1.87 | 0.72 |
| | 1 | No | 4.16 | — | 4.88 | — | 22.51 |
| | 2 | No | 4.16 | — | 4.91 | — | 23.61 |
| | 3 | No | 4.15 | — | 4.78 | — | 19.86 |
| | | | Average | | | — | 21.99 |
| | | | Standard Deviation | | | — | 1.93 |
| 4 | 1 | Yes | 4.24 | 4.34 | nd | 3.28 | — |
| | 2 | Yes | 4.32 | 4.50 | nd | 5.78 | — |
| | 3 | Yes | 4.22 | 4.42 | 5.19 | 6.25 | 24.08 |
| | | | Average | | | 5.11 | 24.08 |
| | | | Standard Deviation | | | 1.60 | — |
| | 1 | No | 4.25 | — | nd | — | — |
| | 2 | No | 4.28 | — | nd | — | — |
| | 3 | No | 4.24 | — | 5.11 | — | 27.20 |
| | | | Average | | | — | 27.20 |
| | | | Standard Deviation | | | — | — |
| 12x | 1 | Yes | 4.24 | 4.41 | 5.12 | 5.32 | 22.20 |
| | 2 | Yes | 4.22 | 4.42 | 5.18 | 6.41 | 23.76 |
| | 3 | Yes | 4.23 | 4.41 | 5.07 | 5.63 | 20.64 |
| | | | Average | | | 5.78 | 22.20 |
| | | | Standard Deviation | | | 0.56 | 1.56 |
| | 1 | No | 4.24 | — | 5.03 | — | 24.70 |
| | 2 | No | 4.18 | — | 4.98 | — | 25.17 |
| | 3 | No | 4.23 | — | 5.14 | — | 28.61 |
| | | | Average | | | — | 26.26 |
| | | | Standard Deviation | | | — | 2.13 |
| 16 | 1 | Yes | 4.22 | 4.43 | 5.04 | 6.72 | 19.07 |
| | 2 | | 4.25 | 4.39 | 5.07 | 4.53 | 21.26 |
| | 3 | | 4.25 | 4.35 | 4.91 | 3.13 | 17.51 |
| | | | Average | | | 4.79 | 19.28 |
| | | | Standard Deviation | | | 1.81 | 1.88 |
| | 1 | No | 4.23 | — | 5.09 | — | 26.89 |
| | 2 | | 4.23 | — | 4.94 | — | 22.36 |
| | 3 | | 4.24 | — | 4.97 | — | 22.83 |
| | | | Average | | | — | 24.03 |
| | | | Standard Deviation | | | — | 2.49 |

[1]Formulation A comprises methyl palmitate, stearate, PVA, span and tween.

TABLE 3A

| Parameter | Formulation 1 | 2 | 3 | 4 | 5 | 6 | 7 | 8 | 9 | 10 | 11 | 12 | 12 | 13 | 14 | 15 |
|---|---|---|---|---|---|---|---|---|---|---|---|---|---|---|---|---|
| Transition enthalpy (J/g) | | | | 137.91 | | | | | | | | 140.17 | 134.77 | | | |
| Transition temperature (° C.) | | | | 20.4-26.6 | | | | | | | | 22.24-25.77 | 20.78-25.98 | | | |
| Solids content (%) | 59.1 | 58.5 | 57.9 | 85 | 85 | 58 | 58 | 58 | 57.7 | 57.7 | 56 | 58 | 58 | 58.1 | 60.1 | 60.2 |
| Viscosity at 40° C. (cP)[1] | PS | PS | PS | 84.4 | PS | PS | PS | PS | GF | GF | PS | PS | PS | PS | PS | PS |
| Viscosity at 40° C. (cP) After homogenisation | PS[1] | PS | PS | 150 | PS | PS | PS | PS | GF | GF | PS | PS | PS | PS | >5k | >5k |
| Stability-1 day | +[2] | + | + | + | | + | + | | | | + | | | | + | + |
| Stability after heating | | | | + | | | | | | | | | | | | |
| Stability after mixing | | | | + | | | | | | | | | | | | |
| Stability after homogenizing | NA | NA | NA | + | NA | NA | NA | NA | NA | NA | NA | NA | NA | NA | | |
| Coatability | + | + | + | + | + | + | + | | | + | | | | | + | + |
| Oily feel/aspect | | | + | + | + | | + | NA | NA | | NA | NA | NA | NA | | |
| % PCM (dry basis) | 86.7 | 88.8 | 91 | 82.4 | 82.4 | 90.7 | 90.7 | 92.8 | 90.3 | 90.3 | 84.1 | 84.1 | 84.1 | 83.8 | 83.8 | 83.5 |

[1]PS: Phase Separation;
[2]+: determined to be acceptable for paper coating

TABLE 3B

| Parameter | Formulation 16 | 17 | 18 | 19 |
|---|---|---|---|---|
| Transition enthalpy (J/g) | 147.03 | | | 136.76 |
| Transition temperature (° C.) | 21.07-26.86 | | | 21.88-26.14 |
| Solids content (%) | 59.6 | 55.8 | 53.2 | 63.4% |
| Viscosity at 40° C. (cP) | PS[1] | PS | PS | PS |
| Viscosity at 40° C. (cP) After homogenisation | >5k | PS | PS | PS |
| Stability-1 day | +[2] | + | + | + |
| Stability after heating | | | | + |
| Stability after mixing | + | | | + |
| Stability after homogenizing | + | NA | NA | NA |
| Coatability | + | + | + | + |
| Oily feel/aspect | + | NA | NA | + |
| % PCM (dry basis) | 84.7 | | | 86.3 |

[1]PS: Phase Separation;
[2]+: determined to be acceptable for paper coating

Example 2

Physical Properties of a PCM Nanoemulsion

Figure 2:
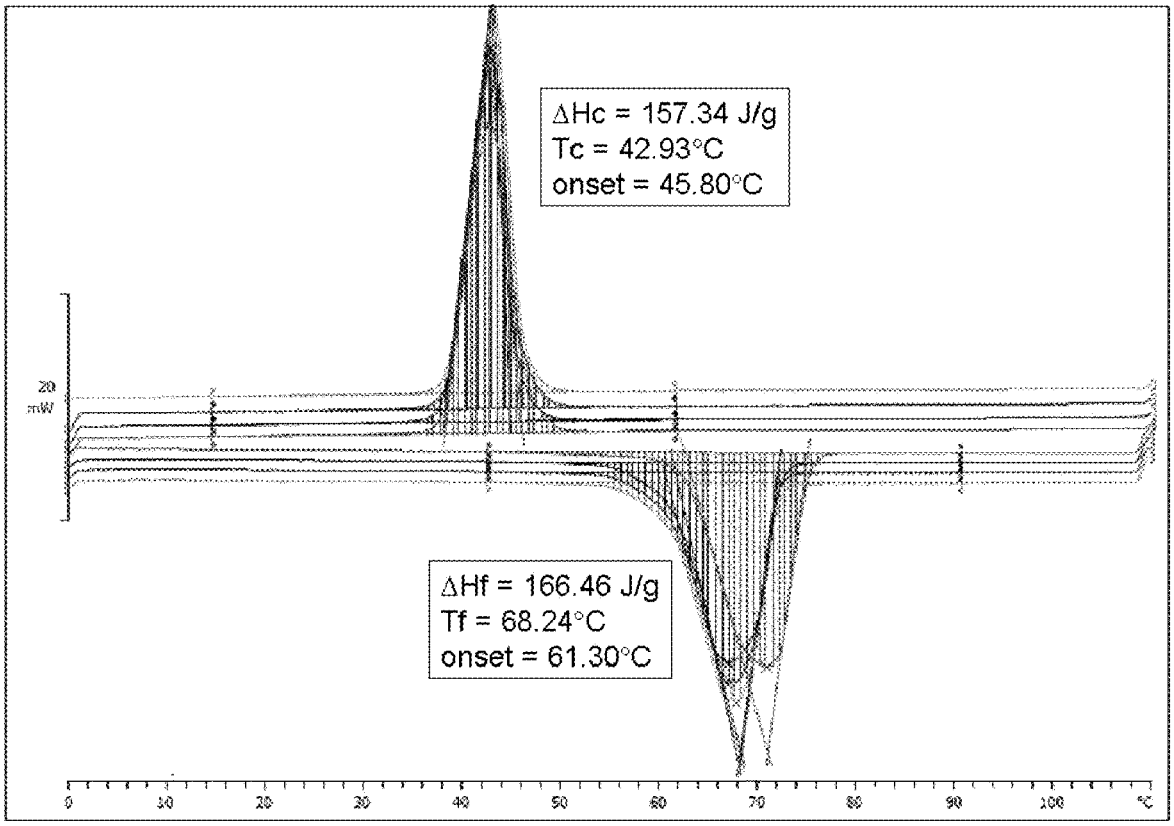
FIG. 2 shows a plot of Dynamic Scanning calorimetry (DSC) measurements for PCM nanoemulsion formulation no. 4. Melting temperature (° C.) and heat enthalpy (J/g) are given. Colored lines represent consecutive thermal cycles of repeated heating and cooling.

We measured thermal properties and viscosity of PCM nanoemulsion formulation no. 4 (see Table 1A). Thermal properties are shown in FIG. 2 which shows Dynamic Scanning calorimetry (DSC) measurements for the formulation. Viscosity at 45° C. (cP) was determined to be 810, with estimated solid content of 42.4%. Viscosity was measured at 45° C. because of measurement limitations at 20° C. due to the spindle used.

DSC measurements were done with a Perkin Elmer DSC using the following program: Heating rate: 10° C./min. Cooling rate: −10° C./min. Temp. range: 0° C. to 110° C. Isotherm between ramps: 5 min. Viscosity measurements were done with a Brookfield rheometer DV-III at 45° C. using a cone-plate geometry CPE-51 (100 cP) with a rotational speed of 50 rpm.

Example 3

Physical Properties of a PCM Nanoemulsion

Figure 3:
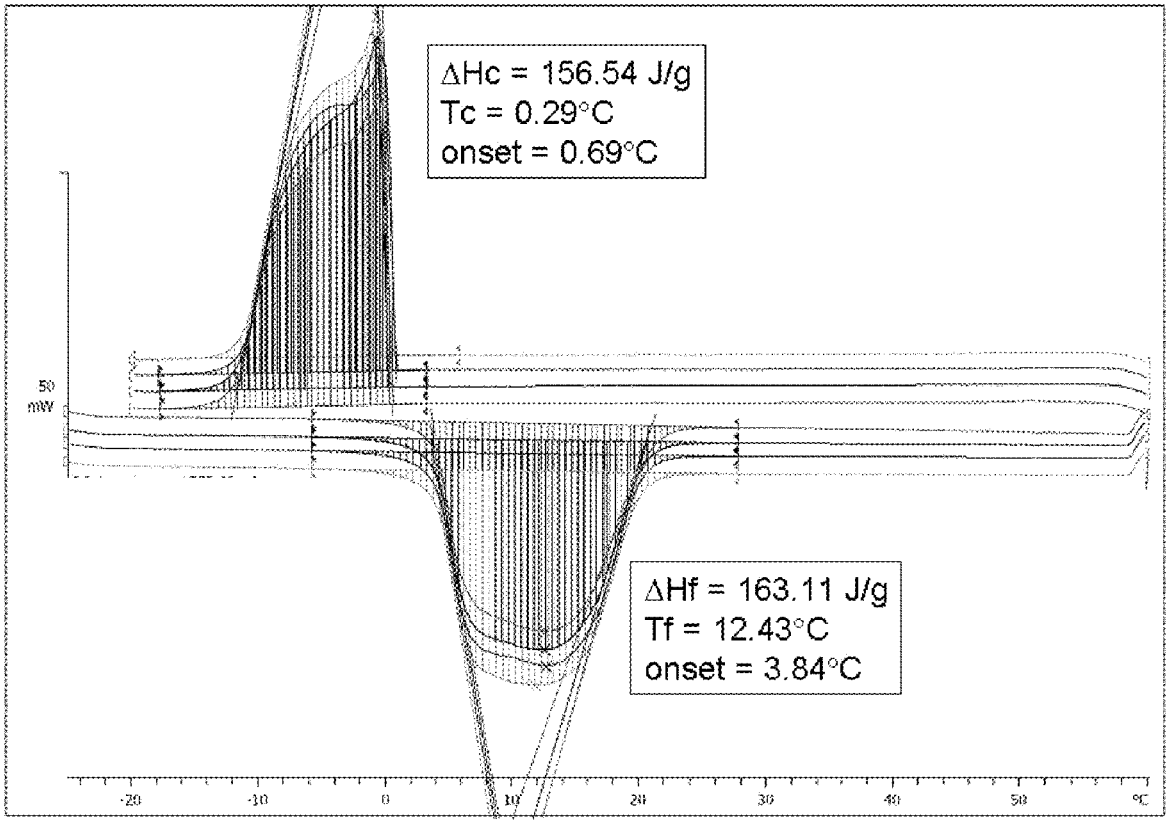
FIG. 3 shows a plot of Dynamic Scanning calorimetry (DSC) measurements for PCM nanoemulsion formulation no. 4. Melting temperature (° C.) and heat enthalpy (J/g) are given. Colored lines represent consecutive thermal cycles of repeated heating and cooling.

We measured thermal properties and viscosity of PCM nanoemulsion formulation no. 4 (see Table 1A). Thermal properties are shown in FIG. 3 which shows Dynamic Scanning calorimetry (DSC) measurements for the formulation. Viscosity at 45° C. (cP) was determined to be 210, with estimated solid content of 40.6%. Viscosity was measured at 45° C. because of measurement limitations at 20° C. due to the spindle used. It can be seen in FIG. 3 that the heat absorption (melting process) started at 3.8±0.04° C., and the heat release (crystallization process) started at 0.7±0.3° C.

DSC measurements were done with a Perkin Elmer DSC using the following program: Heating rate: 10° C./min. Cooling rate: −10° C./min. Temp. range: 0° C. to 110° C. Isotherm between ramps: 5 min. Viscosity measurements were done with a Brookfield rheometer DV-III at 45° C. using a cone-plate geometry CPE-51 (100 cP) with a rotational speed of 100 rpm.

Example 4

Physical Properties of a PCM Nanoemulsion

Figure 4:
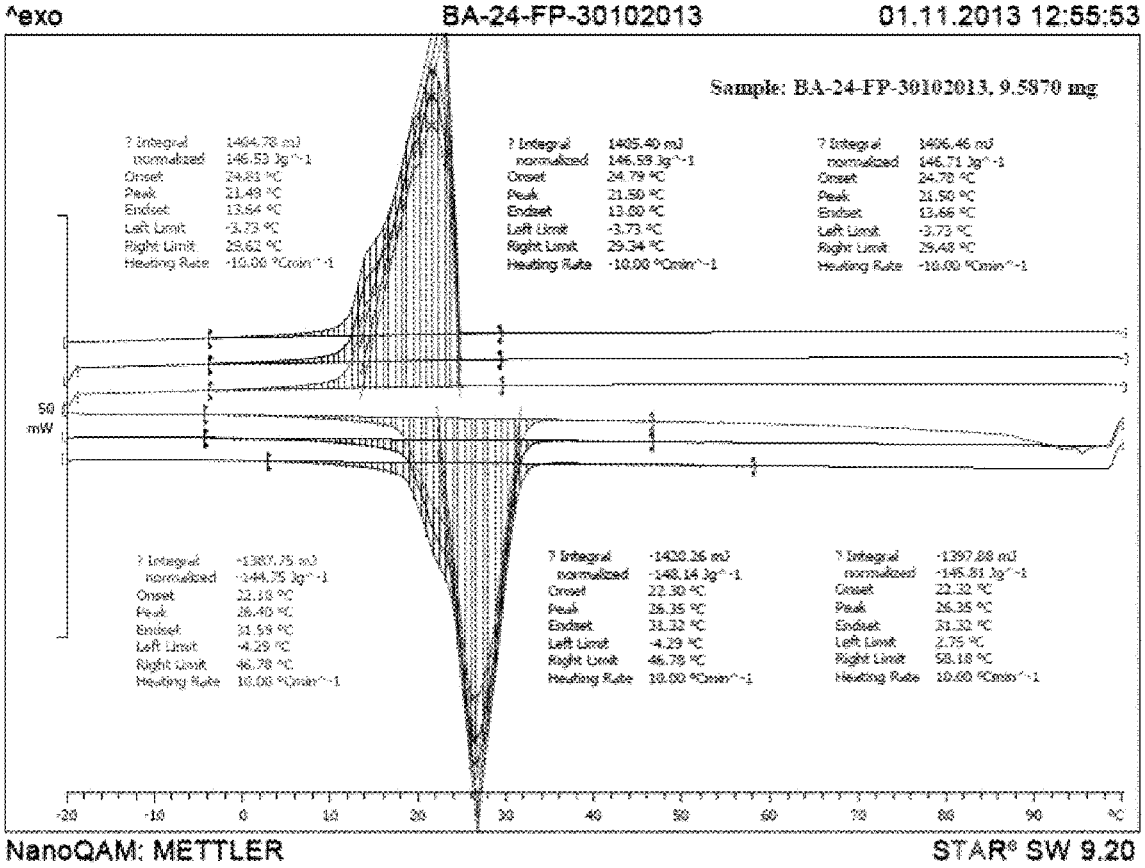
FIG. 4 shows a plot of Dynamic Scanning calorimetry (DSC) measurements for PCM nanoemulsion formulation A. Melting temperature (° C.) and heat enthalpy (J/g) are given. Colored lines represent consecutive thermal cycles of repeated heating and cooling.

We measured thermal properties and viscosity of formulation A (see Table 2), which was produced in a 80 kg batch size. Thermal properties are shown in FIG. 4 which shows Dynamic Scanning calorimetry (DSC) measurements for the formulation. Viscosity at 45° C. (cP) was determined to be 386, with estimated solids content of 56%. Viscosity was measured at 45° C. because of measurement limitations at 20° C. due to the spindle used. It can be seen in FIG. 4 that the melting peak was 26.35° C., the melting enthalpy was 148.1 J/g, the crystallization peak was 21.5° C., and the crystallization enthalpy was 146.5 J/g.

DSC measurements were done with a Metier Toledo DSC machine, running repetitive cycles from −20 to 100° C. at a 10° C./min speed. Viscosity measurements were done with a Brookfield rheometer DV-III at 45° C.±1° C. using a cone-plate geometry CPE-51 (100 cP) with a rotational speed of 100 rpm. Solids content was measured as the percent of mass remaining after drying in an oven at 100° C. until constant weight.

All raw materials used for production of the formulation were considered "Safe" and are included in the FDA's list of food additives permitted for direct and/or indirect addition to food for human consumption.

Figure 5:
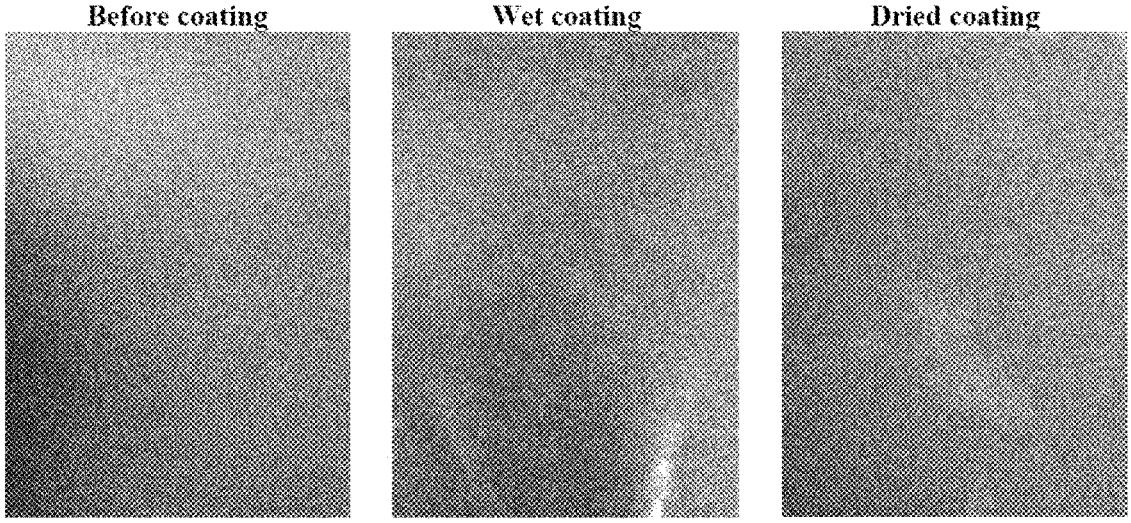
FIG. 5 shows pictures of paper coated with PCM nanoemulsion formulation A, before coating, after coating (wet), and after the coating has been dried (dried coating).

Formulation was applied on a paper at 45° C. Coatability was good and the paper had good appearance after drying (see FIG. 5).

Example 5

Preparation of a PCM Nanoemulsion Formulation

A test formulation was made in a 1 kg batch for testing. The formulation is given in Table 4. The formulation was produced as follows: Water was heated to 80° C. and agitated at 400 rpm while PVA was added slowly. The solution was heated and agitated until PVA was completely dissolved and the solution became viscous. The solution was then cooled down to 35-45° C. and Tween 80 was added under continuous agitation. The temperature was not allowed to go higher or lower than these values. Once the mixture was homogeneous, we started adding half of the fatty acid ester mix slowly, and increased the stirring speed to 600 rpm. Span 85 was added. When total homogenization was achieved, we started adding the other half of the fatty acid ester mix very slowly. Agitation speed was increased from time to time until it reached 1500 rpm. The emulsion was then allowed to cool down to room temperature while agitating at high speed. Once the emulsion was cold it was ready to be stored.

TABLE 4

A PCM nanoemulsion formulation.

| Substance | Weight (g) | % |
|---|---|---|
| 5% PVA aq. Solution (Mw = 89k) | 28.9 | 2.9 |
| Methyl stearate | 86.8 | 8.7 |
| Methyl palmitate | 347.3 | 34.7 |
| Tween 80 | 52.1 | 5.2 |
| Span 85 | 2.6 | 0.3 |
| Water | 482.3 | 48.2 |
| Total | 1000 | 100 |

Example 6

Preparation of a Hydrophobically-modified Polymer for Use as a Topcoat or Basecoat Acetylated PVA for use as a topcoat or basecoat was prepared as follows. A 15% solution of PVA (molecular mass of 89,000 to 90,000, 99% hydrolysis) was dissolved in N-methyl pyrollidone (NMP). Palmitoyl chloride was added drop-wise to the PVA in NMP solution under vigorous stirring, and was left overnight. The resulting modified polymer had either a 10, 15, or 30 degree of substitution depending on the quantities of chloride derivative added. Acetone was added to the resulting solution to precipitate the polymer. The polymer was then purified through dialysis, and the resulting polymer was then lyophilized under vacuum.

Other chloride derivatives of fatty acid esters in addition to palmitoyl chloride could be used in this method. Non-limiting examples of chloride derivatives of fatty acid esters that can be used in this method include palmitoyl chloride, lauroyl chloride, myristoyl chloride and stearoyl chloride.

Example 7

Kit for Coating a Paper with a Thermoregulatory Coating

A kit was provided for preparing a thermoregulatory coating on a paper. The kit included three bottles: 1) a bottle containing PCM nanoemulsion formulation no. 4; 2) a bottle containing a 10% solution of PVA (in water); and 3) a bottle containing HPMC in a solution of 3:1 ethanol:water. The kit also included instructions for applying the coating on the paper. The instructions were as follows: Carefully apply the PVA solution to the paper using a bar coater and thereafter place the paper in an oven at 70° C. to remove all solvent. To the dried basecoat, apply Formulation 4 and dry further using hot air. Finally, apply the HPMC to cover the Formulation and dry at room temperature.

Example 8

Environmental Chamber Test

Figure 6:
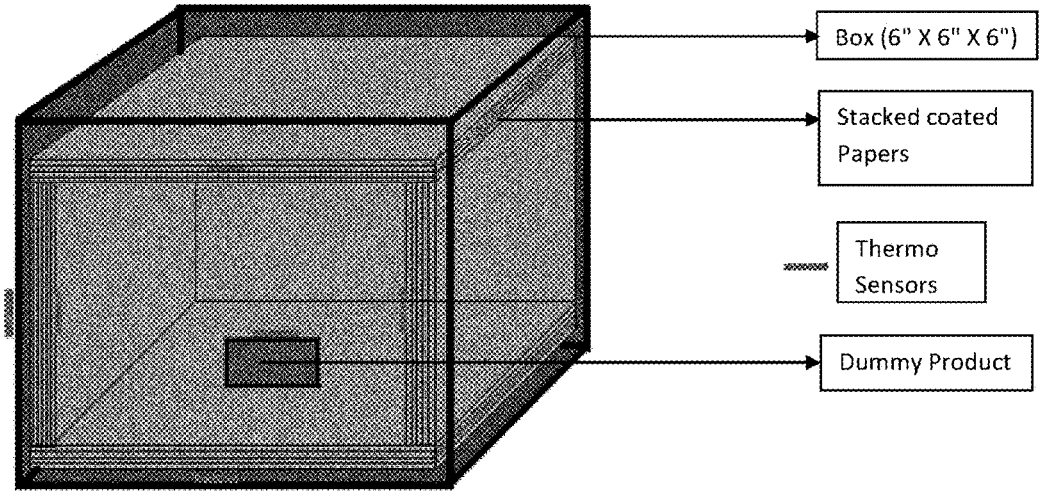
FIG. 6 shows a schematic diagram of the box used for the environmental chamber test.

In order to determine the longevity of a product at 25° C. in simulated conditions, a box was prepared with coated papers stacked inside and a dummy product placed inside the box, along with thermal sensors monitoring the temperature (see FIG. 6). The position and ratio of PCM required to control temperature in a simulated environment was also investigated.

In a small box (6 in.×6 in.×6 in.), coated papers (coated with PCM as described above) were stacked inside the box and the dummy product was placed inside this box with thermal sensors monitoring the temperature. The box was then subjected to different temperature cycles, as follows: crystallized completely overnight in a freezer; then, ramped slowly to 45° C. in 30 min.; and soaked at 45° C. for 4 hours. The total amount of PCM per box was 150 gms. The total amount of sheets was 13 per side with approx. 2 gms of PCM per sheet (both sides). Three boxes were tested: control; PCM only; and PCM with Top and Base coat.

Figure 7:
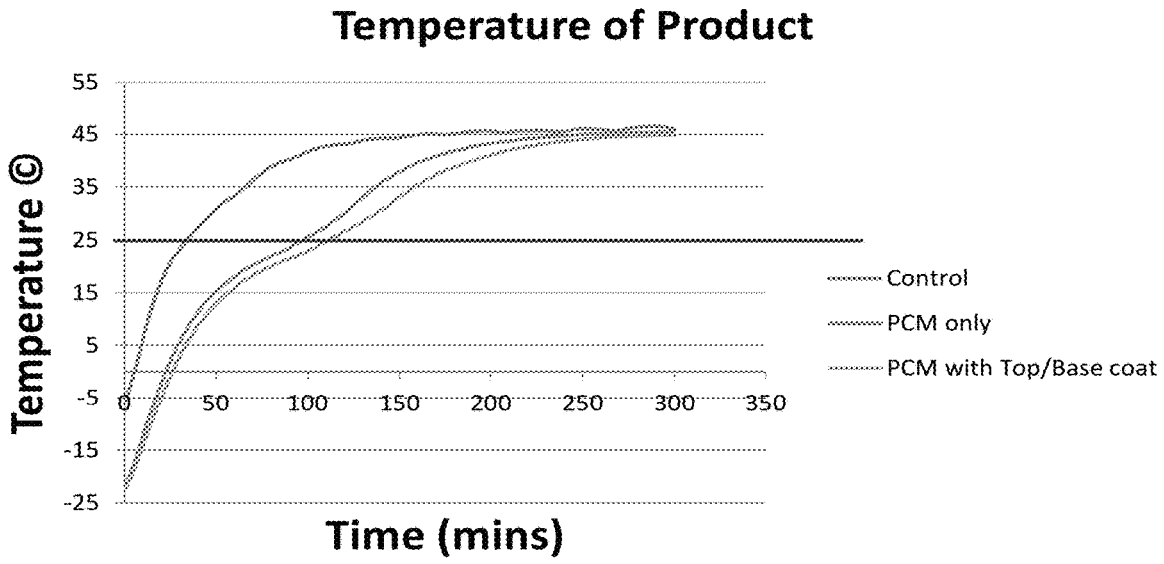
FIG. 7 shows in (A), a graph comparing temperature of the product inside the control box (blue), box with PCM coated papers (orange), and box with papers coated with PCM, Top coat, and Base coate (grey). The temperature (° C.) is plotted vs. time. In (B), there is shown a graph comparing the temperature at different positions inside the boxes, where light blue line shows Control box, temperature sensor located Behind; orange line shows Control box, temperature sensor Between the Sheets; grey line shows Control box, temperature sensor in the Front; yellow line shows box with PCM coated papers, temperature sensor located Behind; dark blue line shows box with PCM coated papers, temperature sensor Between the Sheets; and green line shows box with PCM coated papers, temperature sensor located in the Front.
Figure 7:
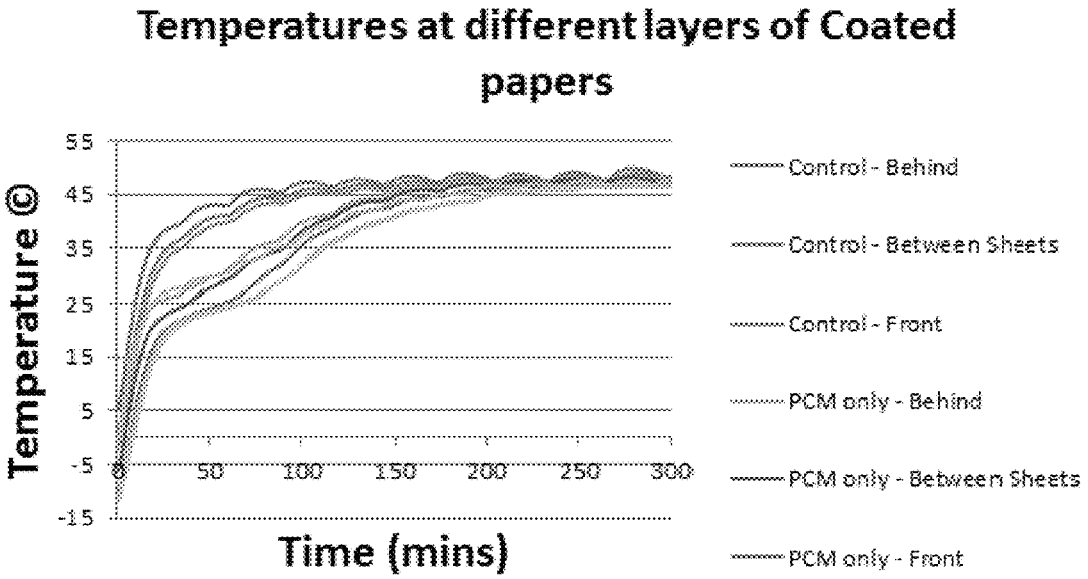

Results are shown in FIG. 7. The time taken for the dummy product to reach 25° C. was 35 minutes for the control box, 98 minutes for the box containing PCM-coated papers, and 112 minutes for the box containing papers coated with base coat, PCM, and top coat.

Example 9

Evaluation of Different Methods of Applying a Coating

In order to evaluate different methods of application of a PCM coating, and to test whether the heat absorption capacity of a PCM formulation could be increased to achieve 60 seconds of protection, we tested a dip coating method of application.

In order to increase the enthalpy, the first step used was to evaluate the performance by increasing the amount of PCM applied to a felt. Using methods described above, the coated material has a formulation with 70% of PCM and has the limitation of further increasing the concentration (enthalpy) of PCM in the system. Therefore, in order to increase the PCM quantity per square meter, a technique was used in which a felt was dipped in a PCM bath; excess PCM was squeezed out; and then the felt was dipped in the bath containing binder to achieve a concentration of 90% PCM and 10% binder. Enthalpy was then compared with the previous formulation containing same concentrations of PCM and Hycar 26552 binder.

Figure 8:
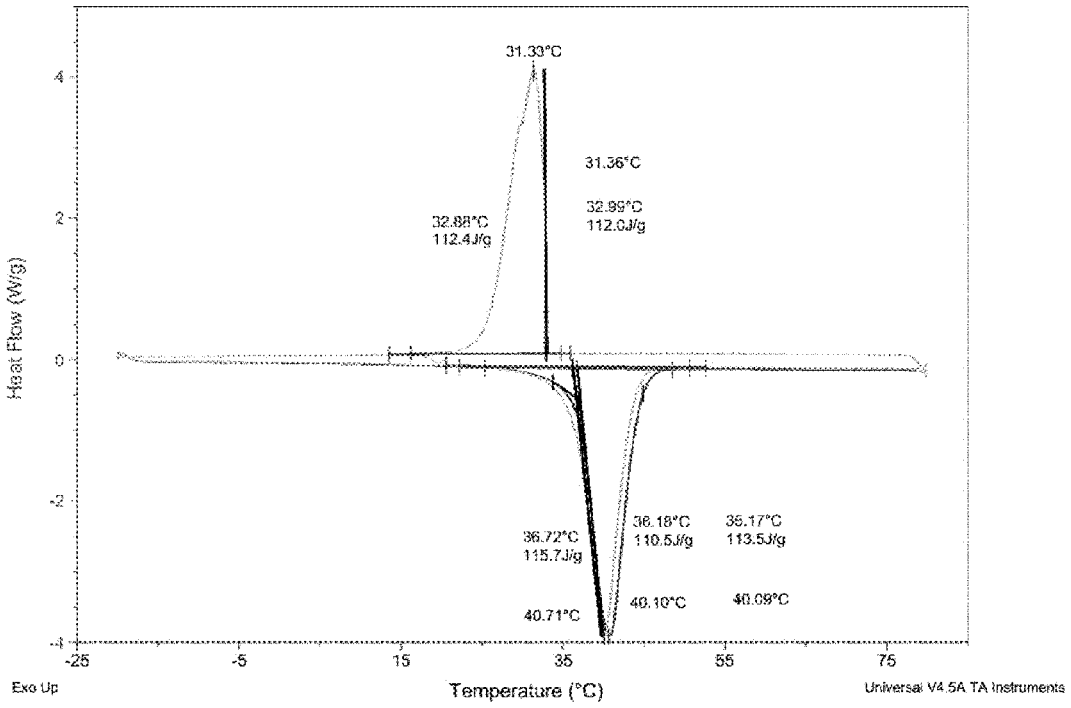
FIG. 8 shows in (A), a plot of DSC measurements (enthalpy per gram of formulation) of a 70/30 dip coated sample, where Dipping Technique was 70/30, Enthalpy was 149.69 J/g±2.09, and Transition Temperature was 40.3° C.±0.25. (B) shows a plot of DSC measurements (enthalpy per gram of formulation) of an emulsion formulation (70/30) coated sample, where Formulation Coating was 70/30, Enthalpy was 180.71 J/g±2.2, and Transition Temperature was 41.77° C.±0.41. (C) shows a plot of DSC measurements (enthalpy per gram of formulation) of a 90/10 dip coated sample, where Dipping Technique was 90/10, Enthalpy was 207.38 J/g±2.55, and Transition Temperature was 41.6° C.±0.32. (D) shows a bar graph of enthalpy per gram of solid for different formulations as indicated, where blue (bars on left of each pair) is melting and red (bars on right of each pair) is crystallization.
Figure 8:
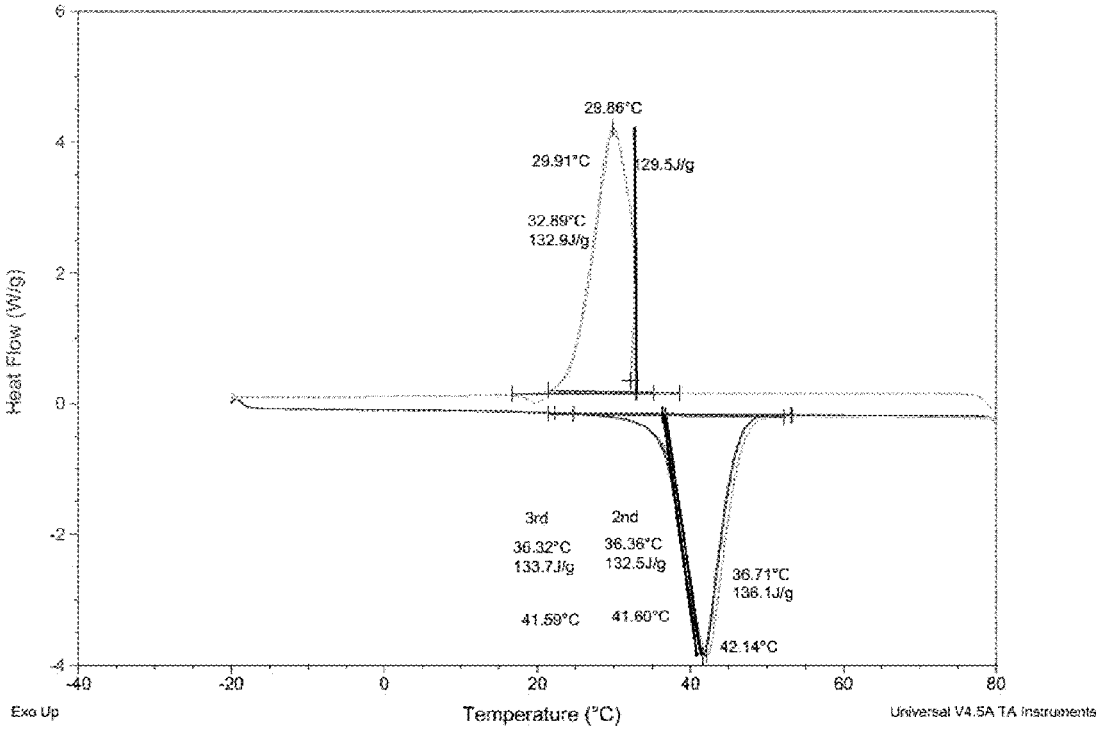
Figure 8:
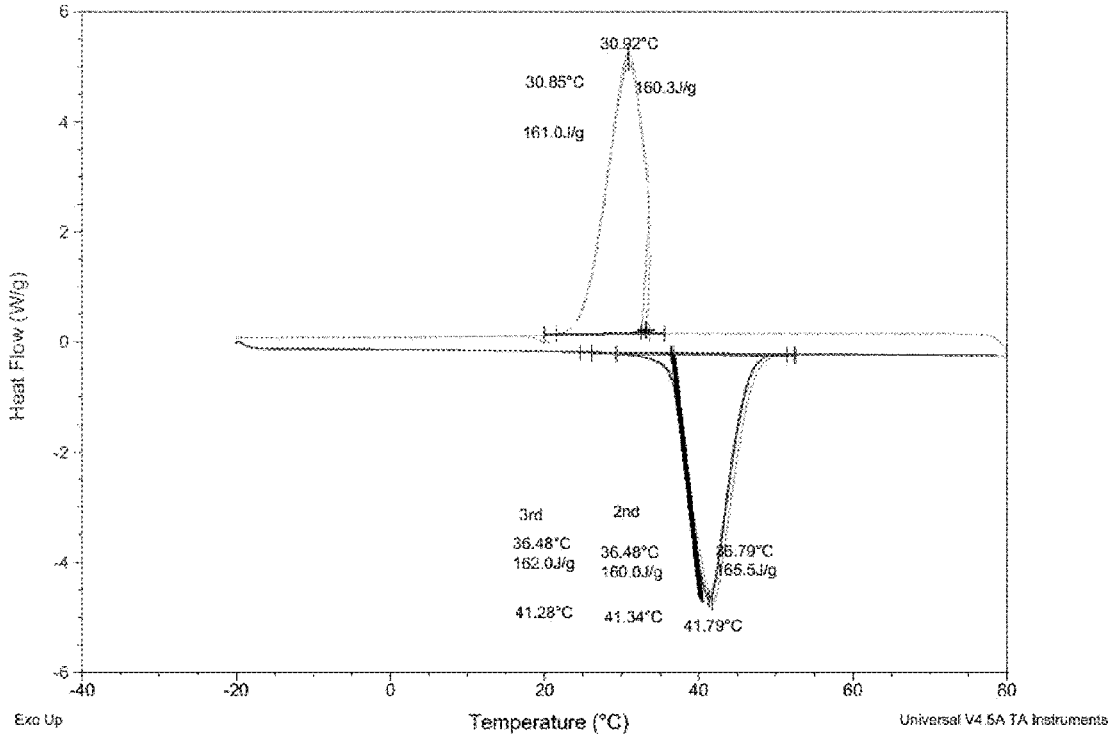
Figure 8:
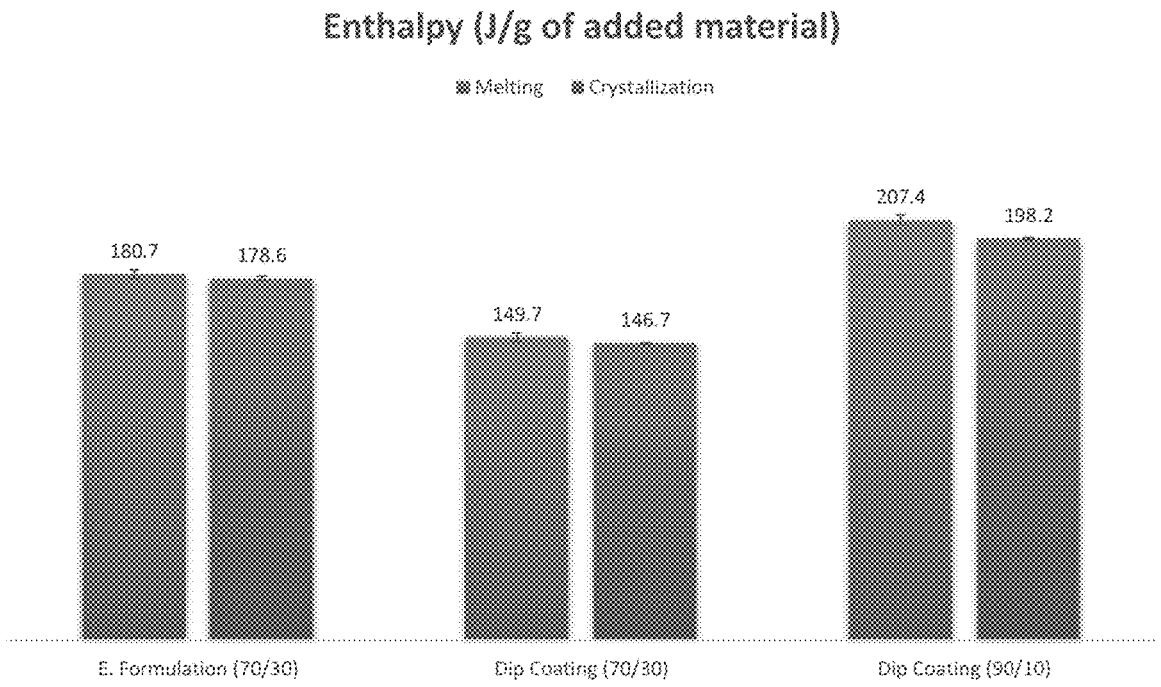

Results are shown in FIG. 8. By changing the method of application from emulsion formulation to individual component dip coating, an increase in the enthalpy of the final coat was clearly observed, from 180 J/g to 207 J/g, i.e., 15% increase. This demonstrated that by dip coating, the amount of PCM in the whole formulation could be increased, which wasn't the case for emulsion formulation.

Example 10

Temperature Responsiveness of PCM Coated Felt

Figure 9:
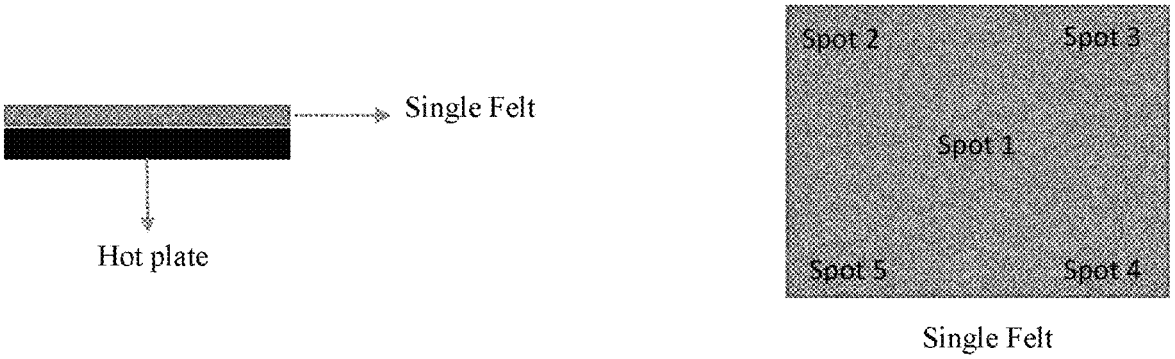
FIG. 9 shows a schematic diagram of the testing set-up for experiments testing the temperature responsiveness of PCM coated felt.

We evaluated the performance of single coated felt at low to moderate heat fluxes. A small test was performed using a hot plate, and exposing the coated and uncoated felt to the hot plate at 100° C. and 150° C. The experimental set up was as follows: the hot plate was set at 150° C. and 100° C.; temperatures were recorded at 5 different spots at 5 sec intervals; single felt coated at 350 GSM and an uncoated felt were tested. The testing set-up is shown schematically in FIG. 9.

Figure 10:
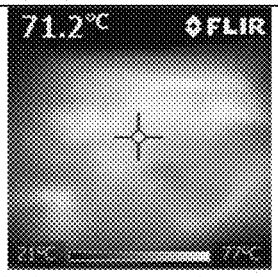
FIG. 10 shows in (A), thermal images of coated and uncoated samples at 100° C. and at 150° C. (B) shows the temperature profile of uncoated felt at 100° C. (red) and 150° C. (blue). (C) shows the temperature profile of coated felt at 100° C. (red) and 150° C. (blue).
Figure 10:
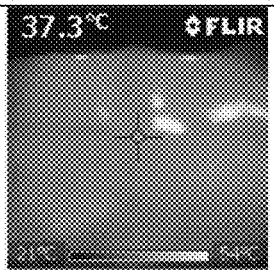
Figure 10:
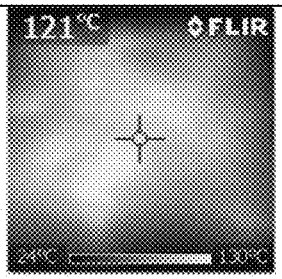
Figure 10:
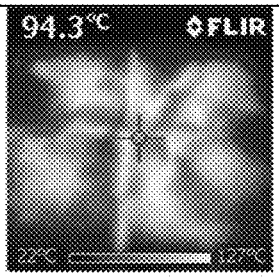
Figure 10:
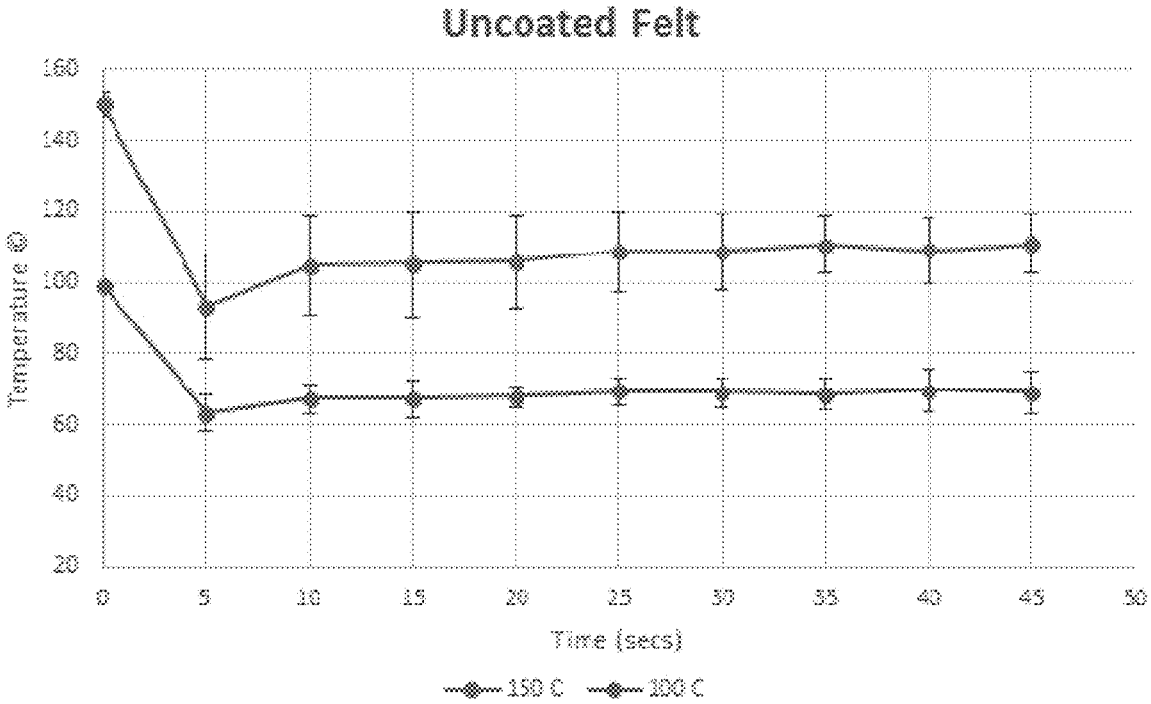
Figure 10:
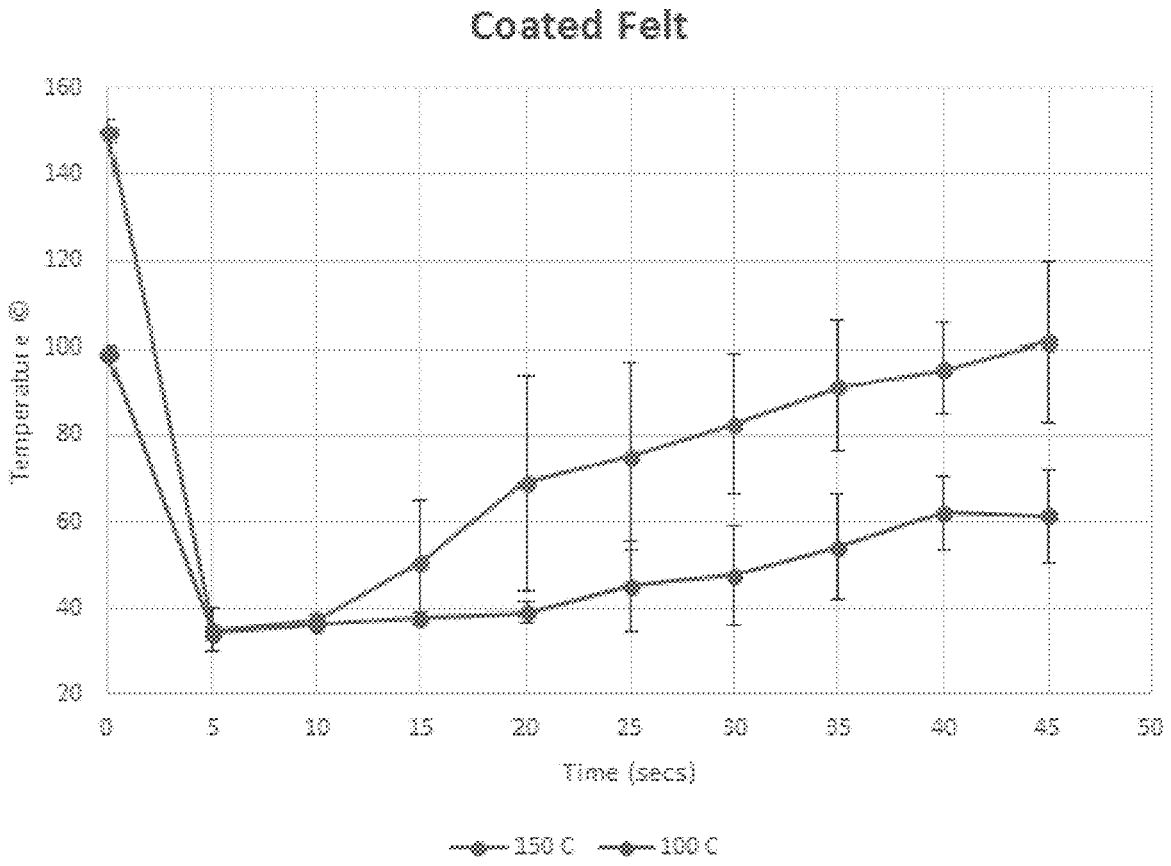

Results are shown in FIG. 10. We found that the PCM coated felt behaved differently based on the temperature it was exposed to. The thermal liner was at 70° C. average when exposed to a heat flux of 2.5 $KW/m^2$. The uncoated felt at 100° C. took about 25 secs to reach close to 70° C. and when it was exposed to 150° C., it was at more than 70° C. right from the start. In contrast, the PCM coated felt took more than 45 secs to reach 70° C. when exposed to 100° C. and 20 secs in the case of 150° C. test temperature. This result clearly indicated that the behavior of the PCM coated felt varied depending on the temperature it was exposed to.

Example 11

PCM Formulations Comprising PVA

Formulations of PCM comprising PVA modified with different kinds of acyl chlorides were prepared and tested. Lauroyl chloride with two different molecular weights (50K and 186K) and octanoyl chloride were used. Formulations were made with 27% of PCM. As used in this example, PCM refers to a mixture of 20 g of Methyl palmitate (MP) +5 g of Methyl stearate (MS).

Synthesis of alkali-stable fatty acid esters of poly(vinyl alcohol) was performed as follows: Modification of PVAL Mw=146-186K, degree of hydrolysis 87-89% (Aldrich cat no. 341584) with alkynoyl (octanoyl or lauroyl) chloride was performed in N-methylpyrrolidone (NMP). Solution of 10% PVAL in NMP was prepared by dissolving the appropriate amount of polymer (14.99 g) in NMP (150.2 g) under magnetic stirring and heating.

After complete dissolution of polymer beads, 55.5 g of the solution (5 g of PVAL, 0.11 mol of monomer units) were mixed with octanoyl (0.840 g, 0.0052 mol) or lauroyl (0.840 g, 0.0054 mol) chlorides. 24 mL of NMP was added to each mixture to reduce its viscosity. Reaction was continued for 4 hrs under magnetic stirring at room temperature. Reaction mixture was then neutralized with NaOH to neutral pH. Polymer was purified by 48 hrs dialysis against water (MWCO=1,000) and freeze-dried.

Theoretical degree of substitution with fatty acid esters was ca. 5 mol %.

Emulsions with the modified PVA were formulated as indicated in Table 5, and as follows: Values in Table 5 are for 50 grams of emulsion. PVA was put in water in a beaker and then heated at 50° C. with stirring at 400 rpm. PVP was added, with stirring continued. In another beaker, the MS and MP were added, heated at 30° C. and stirred at 300 rpm. Tween 80 was added to the PVA and PVP at 40° C. Span 85 was added to the PCM (the MS and MP). The PCM was then added to the mixture of PVA and PVP and stirred at 2000 rpm.

TABLE 5

Formulations of emulsions with modified PVA (50 grams).

| | weight | % weight |
|---|---|---|
| PVA modified | 1.45 g | 1.63 |
| PVP | 0.35 | 0.4 |
| Tween 80 | 2.5 | 2.8 |
| Methyl stearate | 20 | 22.5 |
| Methyl Palmitate | 5 | 5.4 |
| Span 85 | 0.25 | 0.28 |
| Water at 0.1% of Ca(OH)2 | 60 ml | 67.5 |

Figure 11:
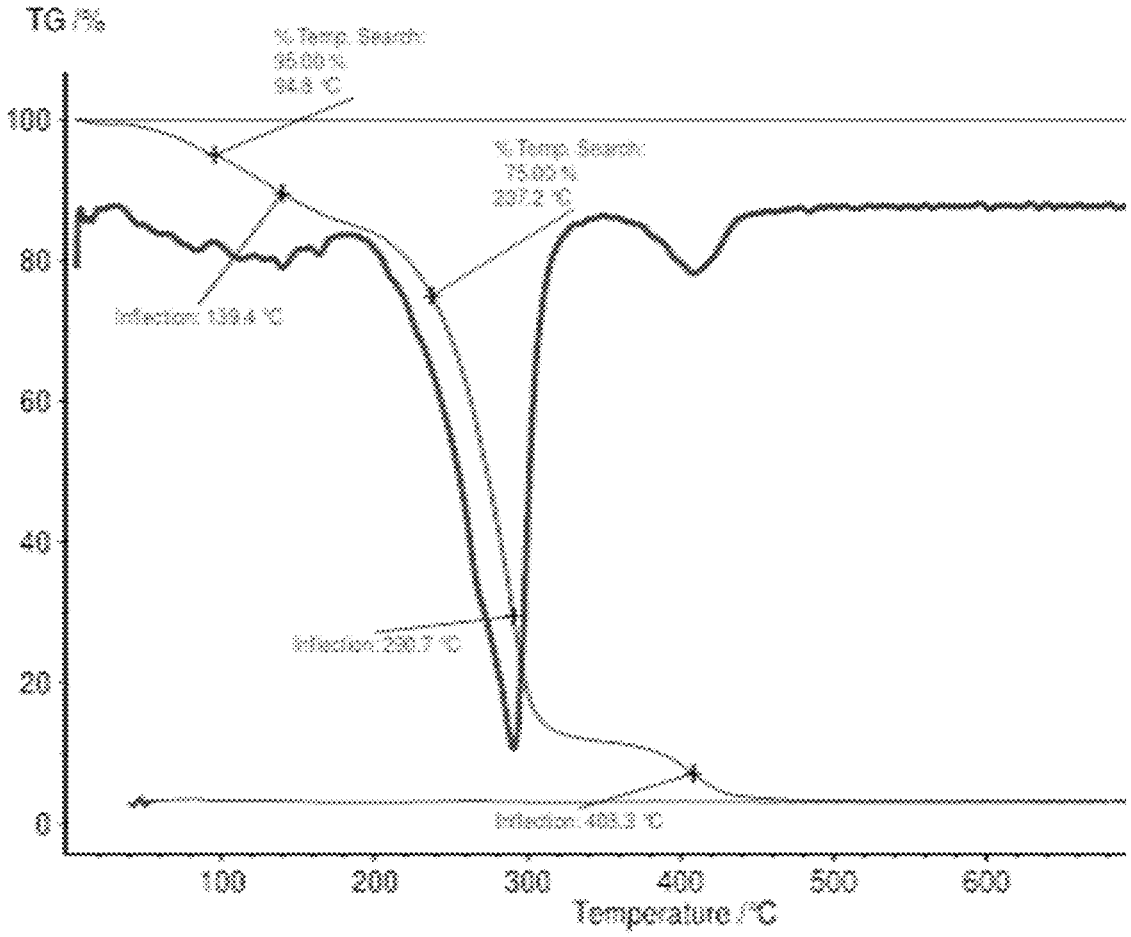
FIG. 11 shows plots of DSC measurements (enthalpy per gram of formulation) for PCM nanoemulsions made with PVA modified with different kinds of acyl chlorides. (A): PVA modified with lauroyl chloride 50, where TGA OVA was modified with 27% of PCM. Two significant inflections to 290.7° C. to 408.3° C. can be seen. The points refer to the PCM for the first and the second one is for PVA lauroyl 50K. These results indicate presence of some residues of water and that the two surfactants used for the emulsion degraded early in the curve at 94° C. (B): PVA modified with 27% of PCM, transition temperature: 30.5° C. (C): PVA modified with lauroyl chloride 186, where TGA PVA was modified with 27% of PCM. Three inflections at 165° C., 318.3° C. and 415.5° C. can be seen. The point at 165° C. was due to the surfactant, and 318.3° C. was for the PCM (Methyl Palmitate/Methyl Stearate, R=4). The last point, 415.5° C., refers to the PVP lauroyl chloride 186K. A small gap can be seen that is certainly due to a better affinity between the PVA lauroyl chloride 186K and the PCM. (D): PVA lauroyl chloride with 27% of PCM, transition temperature: 32.9° C.
Figure 11:
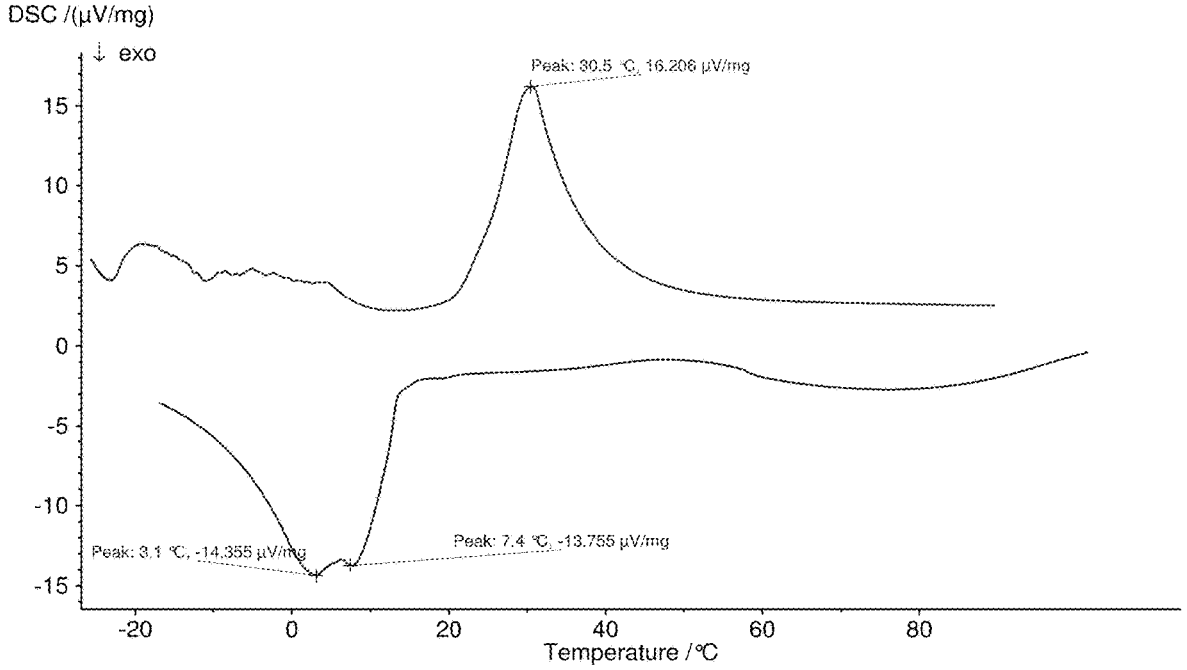
Figure 11:
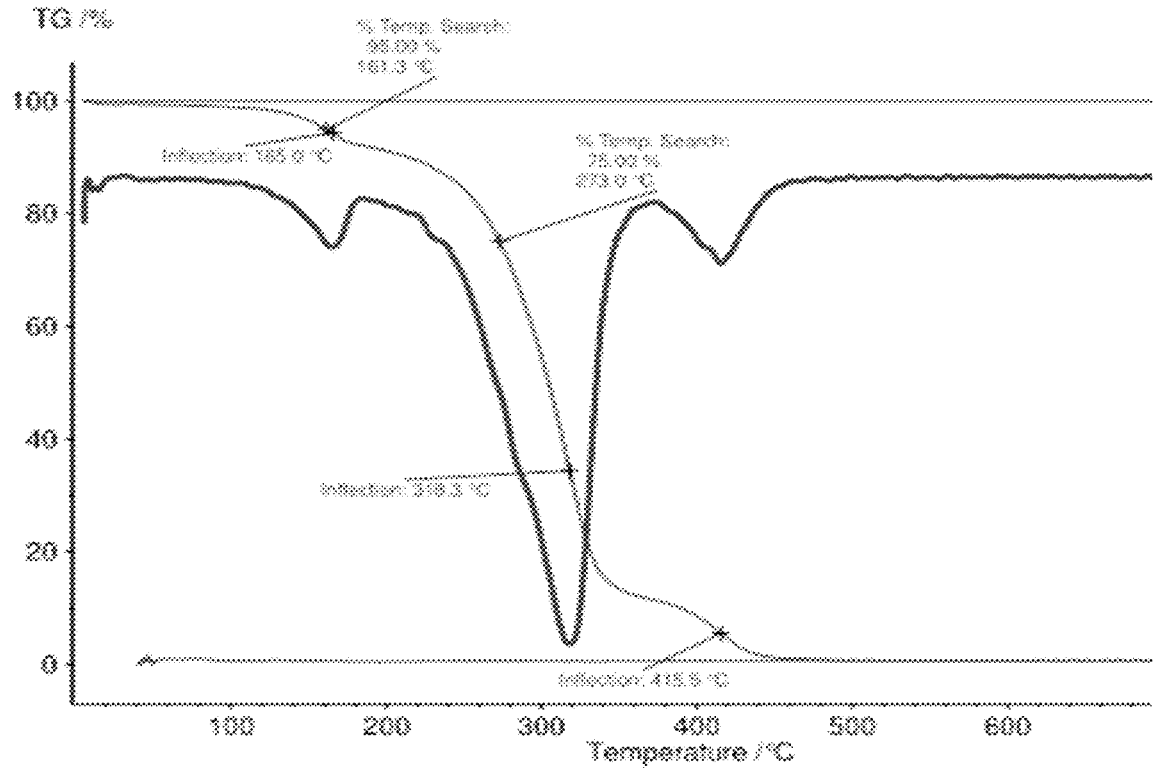
Figure 11:
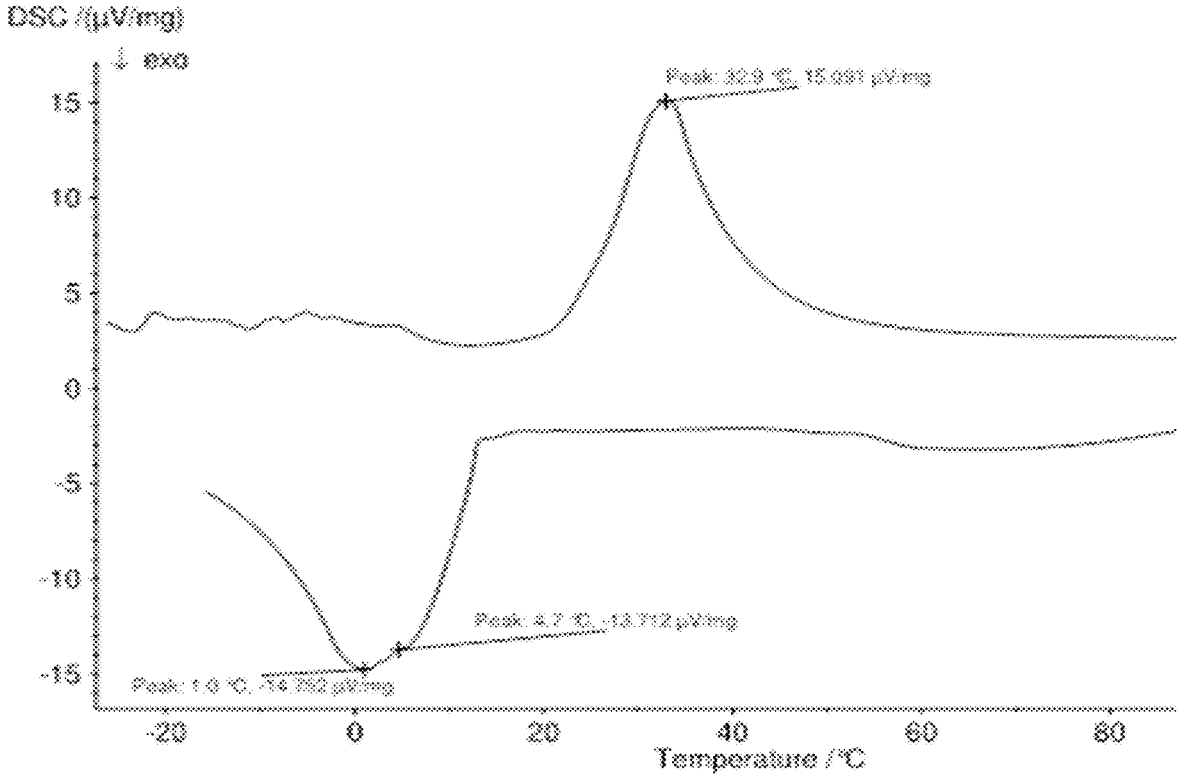
Figure 11:
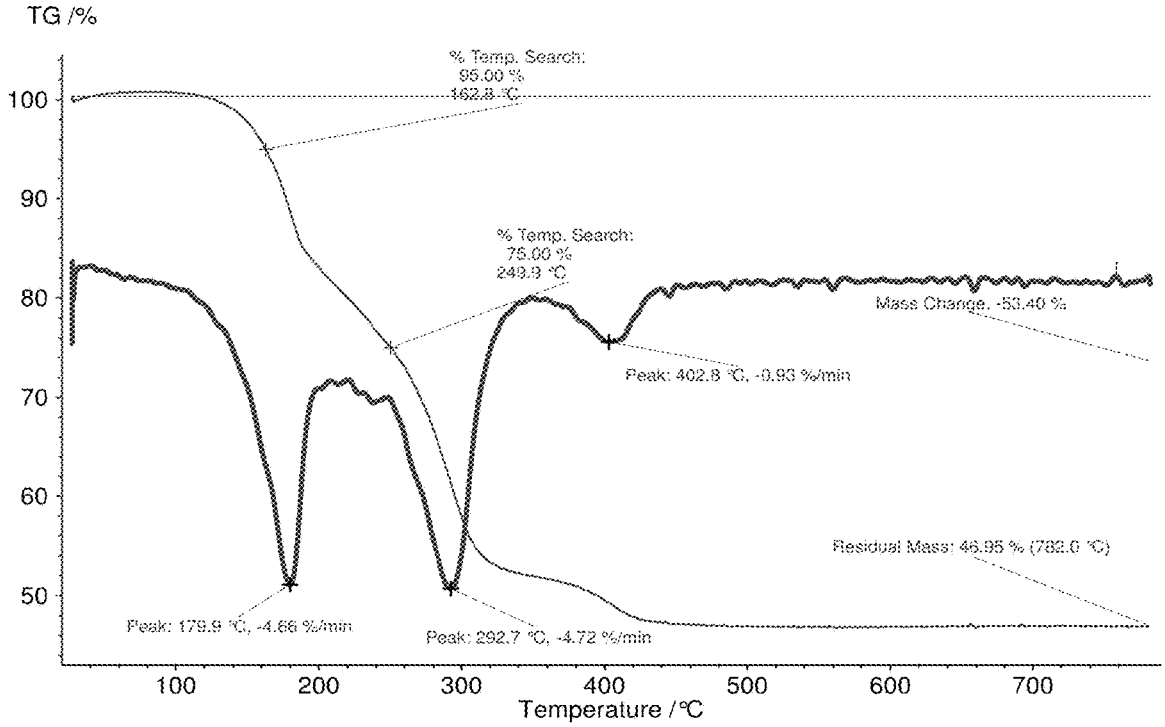
Figure 11:
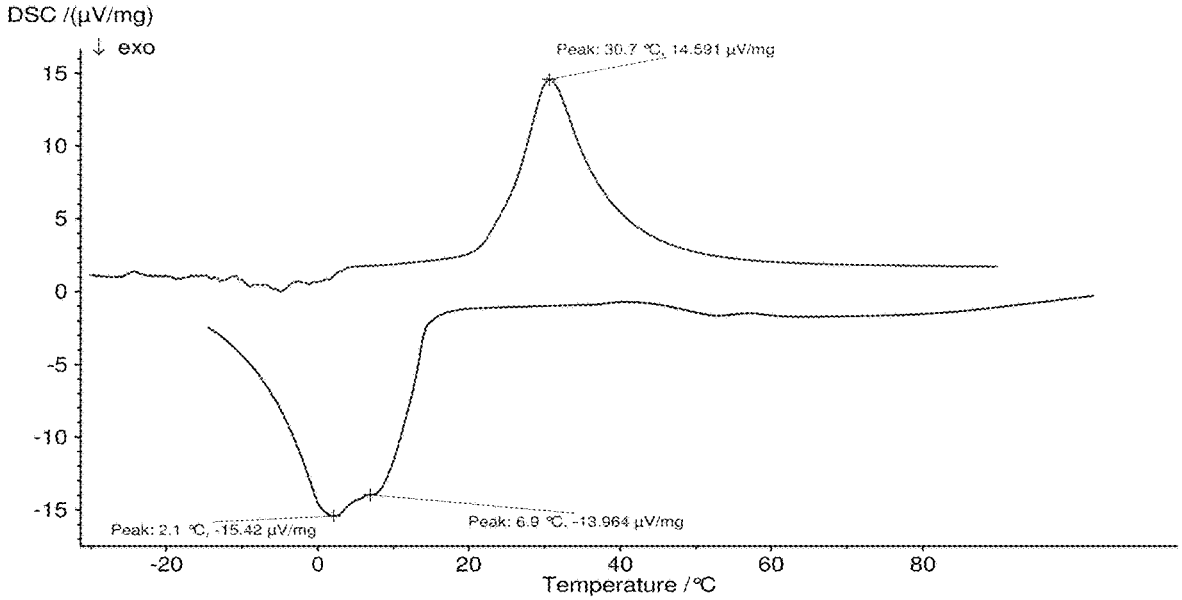

For the TGA measures, they were done between 20 to 800° C. (10K/min) and the DSC, between −20° C. to 120° C. (10K/min). The DSC results (see FIG. 11) showed that all formulations had the same behavior. For PVA lauroyl chloride 50 K, the enthalpy for the emulsion was 163.3 J/g; for PVA lauroyl chloride 186 K the enthalpy for the emulsion was 173.17 J/g, and for PVA octanoyl the enthalpy for the emulsion was 152.58 J/g. The melting temperature of the methyl palmitate was around 30° C. A small gap was seen between the emulsion with PVA lauroyl chloride 50K and that with lauroyl chloride186K. This gap was due to the difference in the molecular weight of the lauroyl chloride. In addition, the lauroyl chloride 186K is more hydrophobic so the emulsion containing it may have had better affinity with the PCM.

These results show that modified acylated polymer produced a significant increase in heat absorption (comparing, for example, the enthalpy for PVA lauroyl chloride 186 K (173.17 J/g) to that of unmodified PVA alone (140 J/g), an increase of about 25%).

Although this invention is described in detail with reference to embodiments thereof, these embodiments are offered to illustrate but not to limit the invention. It is possible to make other embodiments that employ the principles of the invention and that fall within its spirit and scope as defined by the claims appended hereto.

The contents of all documents and references cited herein are hereby incorporated by reference in their entirety.

What is claimed is:

1. A thermoregulatory coating for paper, comprising:

a nanostructured phase-change material (PCM) comprising a PCM nanoemulsion, and at least one protective layer comprising a film-forming polymer, wherein the nanostructured PCM comprises at least one first agent that undergoes a solid-solid phase transition or an endothermic phase transition at a desired transition temperature, wherein at least about 50 J/g is absorbed or released during the solid-solid phase transition;

wherein the PCM nanoemulsion comprises a mixture of fatty acid esters stabilized with sodium caseinate in a continuous phase of poly(vinyl alcohol) or other film-forming polymer.

2. The thermoregulatory coating of claim 1, wherein the at least one protective layer is a topcoat, a basecoat, or comprises both a topcoat and a basecoat.

3. The thermoregulatory coating of claim 1, wherein the nanostructured PCM further comprises at least two phases, at least one phase having dimensions in the nanoscale.

4. The thermoregulatory coating of claim 3, wherein the nanostructured PCM comprises an agent that assists in maintaining the nanoscale dimensions.

5. The thermoregulatory coating of claim 1, wherein the film-forming polymer in the at least one protective layer is selected from chitosan, poly(vinyl alcohol) (PVA), poly (vinylpyrollidone) (PVP), poly(ethylene glycol) (PEG), a polysaccharide, a polyamine, and an amphiphilic polymer that undergoes a hydrophobic-hydrophilic transition at a temperature of at least about 60° C. or of about 60 to about 80° C.; or, wherein the film-forming polymer in the at least one protective layer is hydrophobically-modified.

6. The thermoregulatory coating of claim 5, wherein the amphiphilic polymer that undergoes a hydrophobic-hydrophilic transition at a temperature of at least about 60° C. or of about 60 to about 80° C. is hydroxypropyl methylcellulose, a copolymer of poly(N-isopropylacrylamide) and acrylic acid, or a copolymer of poly(N-isopropylacrylamide) and tert butyl acrylate.

7. The thermoregulatory coating of claim 1, wherein the PCM nanoemulsion is prepared through shear mixing at a speed of about 9000 rpm.

8. The thermoregulatory coating of claim 1, wherein:

the PCM nanoemulsion comprises a continuous phase and a dispersed phase, said dispersed phase comprising at least one first agent that undergoes an endothermic phase transition or a solid-solid phase transition at a desired transition temperature, wherein at least about 50 J/g is absorbed or released during the solid-solid phase transition, and said continuous phase comprising at least one second agent that does not substantially adversely affect heat absorption of the at least one first agent; and the film-forming polymer in the at least one protective layer is a polymer having side-chain pendant hydroxyl groups, wherein said polymer having side-chain pendant hydroxyl groups is optionally hydrophobically modified.

9. The thermoregulatory coating of claim 8, wherein the hydrophobic modification is acetylation.

10. The thermoregulatory coating of claim 8, wherein the polymer having side chain pendant groups is selected from chitosan, acetylated chitosan, poly(vinyl alcohol) (PVA), acetylated PVA, poly(vinylpyrollidone) (PVP), poly(ethylene glycol) (PEG), a polysaccharide, a polyamine, and an amphiphilic polymer that undergoes a hydrophobic-hydrophilic transition at a temperature of at least about 60° C. or of about 60 to about 80° C.

11. The thermoregulatory coating of claim 10, wherein the polymer having side chain pendant groups is an amphiphilic polymer that undergoes a hydrophobic-hydrophilic transition at a temperature of at least about 60° C. or of about 60 to about 80° C.

12. The thermoregulatory coating of claim 11, wherein the amphiphilic polymer that undergoes a hydrophobic-hydrophilic transition at a temperature of at least about 60° C. or of about 60 to about 80° C. is hydroxypropyl methylcellulose or a copolymer of poly(N-isopropylacrylamide) and acrylic acid.

13. The thermoregulatory coating of claim 8, wherein the heat absorption of the polymer having side chain pendant groups is increased by about 10%, about 20%, about 25%, about 30%, or about 40% compared to the heat absorption of the polymer without side chain pendant groups.

14. The thermoregulatory coating of claim 13, wherein the polymer having side chain pendant groups comprises acetylated PVA and the heat absorption of the acetylated PVA is increased by about 10%, about 20%, about 25%, about 30%, or about 40% compared to the heat absorption of non-acetylated PVA.

15. The thermoregulatory coating of claim 8, wherein the at least one first agent is selected from a fatty acid, a fatty acid ester, a low molecular weight phase change polymer, a phase-change polymer, a low-melting small molecule, a paraffin, an oligomer of PEG, and a combination thereof.

16. The thermoregulatory coating of claim 8, wherein the at least one second agent maintains a nanostructure and/or enhances film-forming properties of the PCM nanoemulsion and is an emulsifier, a surfactant, a film-forming polymer, a binder, or a combination thereof.

17. The thermoregulatory coating of claim 16, wherein the at least one second agent is selected from Tween, Sodium Dodecyl Sulphate (SDS), Pectin, Egg Lecithin, Span, sodium caseinate, poly(vinyl alcohol) (PVA), poly(vinyl pyrrolidone) (PVP), hydroxypropyl cellulose (HPC), chitosan, and a combination thereof.

18. The thermoregulatory coating of claim 8, wherein the at least one first agent is selected from methyl palmitate, methyl stearate, PEG, and a mixture thereof.

19. The thermoregulatory coating of claim 8, wherein the at least one first agent is a mix of methyl palmitate and methyl stearate, and the at least one second agent is sodium caseinate; or wherein the at least one first agent is methyl stearate and the at least one second agent is an acrylic emulsion.

20. A coated paper comprising the thermoregulatory coating of claim 1, the coated paper comprising kraft paper, beehive paper, aluminium laminated paper, metallized paper, grease-proof paper, a vacuum panel, board, cardboard, paperboard, a foam insert, or containerboard.

21. The coated paper of claim 20, wherein the paper comprises from about 10 to about 100 grams per square meter of the thermoregulatory coating.

22. A method for preparing paper coated with the thermoregulatory coating of claim 1, the method comprising:

(a) Optionally pretreating the surface of the paper by washing and cleaning the surface to remove contaminants;

(b) Optionally applying a basecoat to the paper, the basecoat comprising the protective layer as defined in claim 1;

(c) Applying a solution comprising the nanostructured PCM as defined in claim 1 to the paper, and mixing;

(d) Drying the solution; and (e) Optionally applying a topcoat to the paper, the topcoat comprising the protective layer as defined in claim 1;

wherein at least one of steps (b) and (e) is performed.

* * * * *